US007453413B2

(12) United States Patent
Larry et al.

(10) Patent No.: US 7,453,413 B2
(45) Date of Patent: Nov. 18, 2008

(54) RECONFIGURABLE PARASITIC CONTROL FOR ANTENNA ARRAYS AND SUBARRAYS

(75) Inventors: Thomas L. Larry, Purcellville, VA (US); Michael L. VanBlaricum, Santa Barbara, CA (US); Andrew S. Richen, Santa Barbara, CA (US)

(73) Assignee: Toyon Research Corporation, Goleta, CA (US)

( * ) Notice: Subject to any disclaimer, the term of this patent is extended or adjusted under 35 U.S.C. 154(b) by 364 days.

(21) Appl. No.: 10/719,011

(22) Filed: Nov. 24, 2003

(65) Prior Publication Data

US 2005/0088358 A1 Apr. 28, 2005

Related U.S. Application Data

(63) Continuation-in-part of application No. 10/206,101, filed on Jul. 29, 2002, now Pat. No. 6,876,337.

(51) Int. Cl.
*H01Q 3/24* (2006.01)
*H01Q 19/00* (2006.01)

(52) U.S. Cl. ..... 343/834; 343/853; 342/372

(58) Field of Classification Search ..... 343/833, 343/834, 844, 853, 895; 342/372, 375, 378
See application file for complete search history.

(56) References Cited

U.S. PATENT DOCUMENTS 3,218,645 A 11/1965 Ehrenspeck
3,560,978 A 2/1971 Himmel et al.
3,656,167 A 4/1972 Lea (Continued)

OTHER PUBLICATIONS

Nakano, et. Al., "Axial Mode Helical Antennas," IEEE Transactions on Antennas and Propagation, vol. AP-34, No. 9 (Sep. 1986), pp. 1143-1148.

(Continued)

*Primary Examiner*—Michael C Wimer
(74) *Attorney, Agent, or Firm*—Nixon & Vanderhye PC

(57) ABSTRACT

Reconfiguration of parasitically controlled elements in a phased array is used to expand the range of operational functions. Embedded array elements can be frequency tuned, and bandwidth can be improved by using reconfiguration to broaden the bandwidth of the embedded elements. For high gain arrays, beam squint can be a limiting factor on instantaneous bandwidth. Reconfiguration can alleviate this problem by providing control of the element phase centers. Scan coverage can be improved and scan blindness alleviated by controlling the embedded antenna patterns of the elements as well as by providing control of the active impedance as the beam is scanned. Applying limited phase control to the elements themselves can alleviate some of the complexity of the feed manifold. A presently preferred method of designing reconfigurable antennas is to selectively place controlled parasitic elements in the aperture of each of the antenna elements in the phased array. The parasitic elements can be controlled to change the operational characteristics of the antenna element. The parasitic elements are controlled by either switching load values in and out that are connected to the parasitic elements or are controlled by applying control voltages to variable reactance circuits containing devices such as varactors. The parasitic elements can be controlled by the use of a feedback control subsystem that is part of the antenna system which adjusts the RF properties of the parasitic components based on some observed metric. The controllable characteristics include directivity control, tuning, instantaneous bandwidth, and RCS.

26 Claims, 22 Drawing Sheets

U.S. PATENT DOCUMENTS

| | | | | |
|---|---|---|---|---|
| 3,725,938 | A * | 4/1973 | Black et al. | 342/435 |
| 3,790,943 | A * | 2/1974 | Pickles et al. | 342/399 |
| 3,846,799 | A | 11/1974 | Gueguen | |
| 3,877,014 | A | 4/1975 | Mailloux | |
| 3,950,753 | A | 4/1976 | Chisholm | |
| 3,996,592 | A | 12/1976 | Kline et al. | |
| 4,260,994 | A | 4/1981 | Parker | |
| 4,387,378 | A | 6/1983 | Henderson | |
| H26 | H | 2/1986 | Dinger | 342/372 |
| 4,631,546 | A | 12/1986 | Dumas et al. | |
| 4,700,197 | A | 10/1987 | Milne | |
| 5,235,343 | A | 8/1993 | Audren et al. | |
| 5,293,172 | A | 3/1994 | Lamberty et al. | |
| 5,294,939 | A | 3/1994 | Sanford et al. | |
| 5,767,807 | A | 6/1998 | Pritchett | |
| 5,905,473 | A | 5/1999 | Taenzer | |
| 5,923,305 | A | 7/1999 | Sadler et al. | |
| 6,034,638 | A | 3/2000 | Thiel et al. | |
| 6,040,803 | A | 3/2000 | Spall | |
| 6,133,882 | A | 10/2000 | LaFleur et al. | |
| 6,198,943 | B1 | 3/2001 | Sadler et al. | |
| 6,249,255 | B1 | 6/2001 | Eggleston | |
| 6,317,100 | B1 | 11/2001 | Elson et al. | |
| 6,407,719 | B1 | 6/2002 | Ohira et al. | |
| 6,448,937 | B1 | 9/2002 | Aiken et al. | |
| 6,492,942 | B1 | 12/2002 | Kezys | |
| 6,515,635 | B2 | 2/2003 | Chiang et al. | |
| 6,600,456 | B2 * | 7/2003 | Gothard et al. | 343/834 |
| 6,677,898 | B2 | 1/2004 | Cheng et al. | |
| 2003/0193446 | A1 | 10/2003 | Chen | |
| 2003/0210206 | A1 | 11/2003 | Phillips et al. | |
| 2004/0036651 | A1 | 2/2004 | Toda | |

OTHER PUBLICATIONS

Nakano, Hisamatsu, Ct al., "Realization of Dual-Frequency and Wide-Band VSWR Performances Using Normal-Mode Helical and Inverted-F Antennas," *IEEE Transactions on Antennas and Propagation*, vol. 46. No. 6, pp. 788-793, Jun. 1998.

Haviland, R.P., "Supergain Antennas: Possibilities and Problems," *IEEE Antennas and Propagation Magazine*, vol. 37, No. 4, pp. 13-26, Aug. 1995.

Waterhouse, R.B., "The Use of Parasitic Elements to Remove Potential E-Plane Scan Blindnesses in High Dielectric Substrate Microstrip Patch Probe-Fed Phased Arrays," *IEEE 0-7803-2009-3/94*, pp. 456-459, 1994.

Ohira, Takashi, "Microwave Signal Processing and Devices for Adaptive Beamforming," *IEEE 0-7803-6369-8/00*, 2000.

Ng, Kwong, T., et al., "Scan-Independent Slot Arrays with Parasitic Wire Arrays in a Stratified Medium," *IEEE Transactions on Antennas and Propagation*, vol. 36, No. 4, pp. 483-495, Apr. 1988.

Herscovici, Naflali, "New Considerations in the Design of Microstrip Antennas," *IEEE Transactions on Antennas and Propagation*, vol. 46, No. 6, pp. 807-812, Jun. 1998.

Clavin, Alvin, et al., "An Improved Element for Use in Array Antennas," *IEEE Transactions on Antennas and Propagation*, vol. AP-22, No. 4, pp. 521-526, Jul. 1974.

Mori, Kouhei, et al., "Active Antenna using Parasitic Elements," *IEEE 0-7803-4478-2/98*, pp. 1636-1639, 1998.

Dahele, J.S., et al., "Experimental Study of the Characteristics of Top-Loaded Microstrip Monopoles," *IEEE Transactions on Antennas and Propagation*, vol. AP-3 1, No. 3, pp. 527-530, May 1983.

Sengupta, Dipak L., "Theory of Double Parasitic Loop Counterpoise Antenna Radiation Patterns," *IEEE Transactions on Antennas and Propagation*, pp. 94-97, Jan. 1973.

Au, Tsien Ming, et al., "Effect of Parasitic Element on the Characteristics of Microstrip Antenna," *IEEE Transactions on Antennas and Propagation*, vol. 39, No. 8, pp. 1247-1251, Aug. 1991.

Anguera, Jaume, "Miniature WideBand Stacked Microstrip Patch Antenna Based on the Sierpinski Fractal Geometry." *IEEE 0-7803-6369-8/00*, 2000.

Sanad, Mohamed, "Non-Planar Shorted Double C-Patch Antennas for Portable Communication Equipment," *IEEE 0-7803-3216-496*, pp. 738-741, 1996.

Sengupta, Dipak L., et al., "On the Radiation Patterns of Parasitic Loop Counterpoise Antennas," *IEEE Transactions on Antennas and Propagation*, vol. AP-18, No. 1, pp. 34-41, Jan. 1970.

Obmine, Hiroyuki, et al., "An Annular-Ring Microstrip Antenna Fed by a Co-Planar Feed Circuit for Mobile Satellite Communication Use," *IEEE Transactions on Antennas and Propagation*, vol. 45, No. 6, pp. 1001-1008, Jun. 1997.

Lee, R.Q., et al., "Enhancement of Array Gain with Stacked Parasitic Elements" *IEEE 0-0 7803-2009-3/94*, pp. 468-471, 1994.

Liu, W.C., et al., "Optimized Shaped Parasitic Array Using the Genetic Algorithm," *IEE Proc.-Microw. Antennas Propag.*, vol. 146, No. 5, pp. 339-341, Oct. 1999.

Ng, Kwong T., "Surface-Wave Phenomena in Phased Slot Arrays with Parasitic Wire Arrays," *IEEE Transactions on Antennas and Propagation*, vol. 37, No. 11, pp. 1398-1406, Nov. 1989.

Pozar, David M., "Scanning Characteristics of Infinite Arrays of Printed Antenna Subarrays," *IEEE Transactions on Antennas and Propagation*, vol. 40, No. 6, pp. 666-674, Jun. 1992.

Elliott, R.S., et al., "Parasitic Arrays Excited by Surface Waves," *IEEE Transactions on Antennas and Propagation*, pp. 140-142, Jul. 1955.

Staraj, Robert, et al., "Infinite Phased Arrays of Microstrip Antennas with Parasitic Elements: Application to Bandwidth Enhancement," *IEEE Transactions on Antennas and Propagation*, vol. 42, No. 5, pp. 742-746, May 1994.

Seth, Devendra P.S., et al., "On Linear Parasitic Array of Dipoles with Reactive Loading," *IEEE Transactions on Antennas and Propagation*, vol. AP-21, No. 3, pp. 286-292.

Thiel, David V., et al., "Electronic Beam Steering in Wire and Patch Antenna Systems Using Switched Parasitic Elements," *IEEE 0-7803-3216-4/96*, pp. 534-537, 1996.

Lin, C.J., et al., "Parasitic Array of Two Loaded Short Antennas," *IEEE Transactions on Antennas and Propagation*, vol. AP-21, No. 6, pp. 852-855, Nov. 1973.

Huang, John, et al., "Microstrip Yagi Array Antenna for Mobile Satellite Vehicle Application," *IEEE Transactions on Antennas and Propagation*, vol. 39, No. 7, pp. 1024-1030, Jul. 1991.

Kahn, Walter K., "Current on Generalized Yagi Structures," *IEEE Transactions on Antennas and Propagation*, vol. AP-27, No. 6, pp. 788-797, Nov. 1979.

Zhang, Yimin, et al., "Opened Parasitic Elements Nearby a Driven Dipole," *IEEE Transactions on Antennas and Propagation*, vol. AP-34, No. 5, pp. 711-713, May 1986.

Korekado, Toshikazu, et al., "Design Method of Yagi-Uda Two-Stacked Circular Loop Array Antennas," *IEEE Transactions on Antennas and Propagation*, vol. 39, No. 8, pp. 1112-1118, Aug. 1991.

Cheng, David K., et al., "Optimum Element Spacings for Yagi-Uda Arrays," *IEEE Transactions on Antennas and Propagation*, vol. AP-21, No. 5, pp. 615-623, Sep. 1973.

Chen, C.A., et al., "Optimum Element Lengths for Yagi-Uda Arrays," *IEEE Transactions on Antennas and Propagation*, vol. AP-23, No. 1, pp. 8-15, Jan. 1975.

Viezbicke, Peter P., "Yagi Antenna Design," *US. Government Printing Office Washington SD Catalog No. C13.46:688*), 27 pages, Dec. 1976.

Ebrenspeck, H.W., et al., "Two-Dimensional Endfire Array with Increased Gain and Side Lobe Reduction," pp. 2 17-230.

Lindsay, James E. Jr., "A Parasitic End-Fire Array of Circular Loop Elements," *IEEE Transactions on Antennas and Propagation*, pp. 697-698, Sep. 1967.

Vaughan, Rodney, Switched Parasitic Elements for Antenna Diversity, *IEEE Transactions on Antennas and Propagation*, vol. 47, No. 2, pp. 399-405, Feb. 1999.

Dinger, Robert J., "A Planar Version of a 4.0 GHz Reactively Steered Adaptive Array," *IEEE Transactions on Antennas and Propagation*, vol. AP-34, No. 3, pp. 427-431, Mar. 1986.

Dinger, Robert J., A Computer Study of Interference Nulling by Reactively Steered Adaptive Arrays, *IEEE CH2043-8/84/0000/0807*, pp. 807-810, 1984.

Dinger, Robert J., "Reactively Steered Adaptive Array Using Microstrip Patch Elements at a a4 GHz," *IEEE Transactions on Antennas and Propagation*, vol. 32, pp. 848-856, Aug. 1984.
Dinger, Robert J., "A Microstrip Power Inversion Array Using Parasitic Elements," pp. 19 1-194.
Dinger, Robert J., "Adaptive Microstrip Antenna Array Using Reactively Terminated Parasitic Elements," pp. 300-303.
Dinger, Robert J., Spatial Prefiltering of Interference Sources Using Subarrays of Reactively Steered Adaptive Arrays, pp. 965-968.
Harrington, Roger F., "Reactively Controlled Directive Arrays," *IEEE Transactions on Antennas and Propagation*, vol. AP-26, No. 3, pp. 390-395, May 1978 Note: This key paper was referenced by inclusion originally in Dinger.
Schlub, R., et al., "Dual Bankd Switched-Parasitic Wire Antennas for Communications and Direction Finding," from Asia-Pacific Microwave Conference 2000, Sydney, pp. 28 1-285, 2000.
Preston, Stephanie, et al., "Direction Finding Using a Switched Parasitic Antenna Array," *IEEE 0-7803-41 78-/3/97*, pp. 1024-1027.
Preston, Stephanie L., et al., "Base-Station Tracking in Mobile Communications Using a Switched Parasitic Antenna Array," *IEEE Transactions on Antennas and Propagation*, vol. 46, No. 6, pp. 841-844, Jun. 1998.
Schaer, B., "A Simple Algorithm for the Control of Reactances in Beam Steering Applications with Parasitic Elements," *IEEE 0-7803-819 7-1/03*, 2003.
Kagoshima, Kenichi, "Pattern Control Antennas for Wireless Access Systems," *IEEE 0-7803-6369-8/00*, 2000.
Harrington, Roger F., et al., "Electromagnetic Scattering by Loaded Wire Loops," *Radio Science*, vol. 1, No. 3. pp. 347-352, Mar. 1996.
Harrington, Roger F., et al., "Theory of Loaded Scatterers," *Proc. IEE*, vol. 111, No. 4, pp. 6 17-623, Apr. 1964.
Schindler, J.K., et al., "The Control of Electromagnetic Scattering by Impedance Loading," *Proceedings of the IEEE*, pp. 993-1003, Aug. 1965.
Harrington, Roger F., et al., "Optimization of Radar Cross Section of N-Port Loaded Scatterers," *IEEE Transactions on Antennas and Propagation*, vol. AP-22, No. 5, pp. 697-701, Sep. 1974.
McMahon, E. Lawrence, "Circuit Realizations of Impedance Loading for Cross Section Reduction," *Air Force Cambridge Research Laboratories*, AFCRL-70-05 14, Scientific Report No. 8, Sep. 1970.
Chen, Kun-Mu, "Minimization of End-Fire Radar Echo of a Long Thin Body by Impedance Loading," *IEEE Transactions on Antennas and Propagation*, vol. AP-14, No. 3, pp. 3 18-323, May 1966.
Garbacz, Robert J., et al., "Antenna Shape Synthesis Using Characteristics Modes," *IEEE Transactions on Antennas and Propagation*, vol. AP-30, No. 3, pp. 340-350, May 1982.
Liepa, V.V., et al., "Modification to the Scattering Behavior of a Sphere by Reactive Loading," *Proceedings of the IEEE*, pp. 1004-1011, Aug. 1965.
Bevensee, R.M., "Radar Cross Section Reduction by Lumped, Linear, Passive Loading," *Lawrence Livermore National Laboratory*.
Harrington, Roger F., et al., "Control of Radar Scattering by Reactive Loading," *IEEE Transactions on Antennas and Propagation*, vol. AP-20, No. 4, pp. 446-454, Jul. 1972.
Kolsrud, Arild t., et al., "Frequency Tunable CPW-Fed CPS Dipole Antenna Using Varactors," *IEEE 0-7803-4478-2/98*, pp. 308-311, 1998.
Linden, Derek S., "In-situ Evolution of a Reconfigurable Antenna," *IEEE 0-7803-6599-2/01*, pp. 5-2333-5-233 8, 2001.
Coleman, C.M., et al., "Self-Structuring Antennas," *IEEE Antenna's and Propagation Magazine*, vol. 44, No. 3, pp. 11-22, Jun. 2002.
Schaubert, Daniel H., et al., "Post-Tuned Microstrip Antennas for Frequency-Agile and Polarization-Diverse Applications," *US. Army Electronics Research and Development Command*, Harry Diamond Laboratories, HDL-TM-81-8, 30 pages. Mar. 1981.
Schaubert, Daniel H., "Conformal Dielectric-Filled Edge-Slot Antennas for Bodies of Revolution," *US. Army Materiel Development and Readiness Command*, Harry Diamond Laboratories, HDL-TR-1837, 25 pages, Sep. 1977.
Schaubert, Daniel H., et al., "Conformal Dielectric-Filled Edge-Slot Antennas with Inductive-Post Tuning," *IEEE Transactions on Antennas and Propagation*, vol. AP-27, No. 5, pp. 713-716, Sep. 1979.
Schaubert, Daniel H., et al., "Microstrip Antennas with Frequency Agility and Polarization Diversity," *IEEE Transactions on Antennas and Propagation*, vol. AP-29, No. 1, pp. 118-123, Jan. 1981.
Schaubert, Daniel H., et al., "Series-Fed, Dielectric-Filled, Edge-Slot Antennas," *IEEE CHJ 456-3/79/0000-0142*, pp. 142-145, 1979.
Sengupta, Dipak L., et al., "Theory of the Input Behavior of a Dielectric-Filled Edge-Slot Antenna," *IEEE CHJ 456-3/79/0000-0138*, pp. 138-141, 1979.
Richards, William F., et al., ":Theoretical and Experimental Investigation of a Microstrip Radiator with Multiple Lumped Linear Loads," *Electromagnetics*, 3:371-387, 1983.
Waterhouse, R.B., "Theoretical Investigation of the Effects of Substrate Parameters on the Performance of Diode Loaded Microstrip Patches," *IEEE 0-7803-2009-3/94, pp. 790-793*, 1994.
Waterhouse, R.B., et al., "Frequency Agile Microstrip Rectangular Patches Using Varactor Diodes," *IEEE 0-7803-0730-5/92*, pp. 2188-2191, 1992.
Waterhouse, Rod B., et al., "Scan Performance of Infinited Arrays of Microstrip Patch Elements Loaded with Varactor Diodes," *IEEE Transactions on Antennas and Propagation*, vol. 41, No. 9, pp. 1273-1280, Sep. 1993.
Robert, Bernard, et al., "Capacitors Provide Input Matching of Microstrip Antennas," *Microwaves* & RF, pp. 103-106, Jul. 1994.
Purchine, Michael P., et al., "A Tunable L-Band Circular Microstrip Patch Antenna," *Microwave Journal*, pp. 80-88, Oct. 1993.
Sor, James, et al., "Multi-Mode Microstrip Antennas for Reconfigurable Aperture," *IEEE 0-789306369-8/00*, pp. 318-320, 2000.
Chang, B.C.C., et al., "A Reconfigurable Leaky Mode/Patch Antenna Controlled by PIN Diode Switches," *IEEE 0-7803-5638-X/99*, pp. 2694-2697, 1999.
Yang, F., et al., "Switchable Dual-band Circularly Polarised Patch Antenna with Single Feed," *Electronic Letters*, vol. 37, No. 16, pp. 1002-1003, Aug. 2, 2001.
Huff, G.H., et al., "A Small Array of Boresight to Endfire Radiation Reconfigurable Antennas," pp. 147-161, Allterton Antenna Conference, Sep. 17-19, 2003.
Priebe, D.A. et al., "Bandwidth Enhancement of Small Scatterers by Means of Passive Loading", 16th Annual Symposium on USAF Antenna Research and Development, Robert Allerton Park, University of Illinois, Oct. 11-13, 1966.

* cited by examiner

RECONFIGURABLE PARASITIC CONTROL FOR ANTENNA ARRAYS AND SUBARRAYS

RELATED APPLICATIONS

This is a continuation-in-part of commonly assigned application Ser. No. 10/206,101 filed Jul. 29, 2002 entitled "A Small Controlled Parasitic Antenna System and Method for Controlling Same to Optimally Improve Signal Quality" and naming Thomas L. Larry as sole inventor (now U.S. Pat. No. 6,876,337 which is hereby incorporated by reference).

BACKGROUND OF THE INVENTION

1. Field of the Invention

The present invention relates to the field of antennas. Specifically, it relates to the control (including beam and null steering and tuning) of phased arrays and subarrays by using parasitic control elements in the aperture of each individual antenna element in the array.

2. Related Art

Array antennas refer to the class of antennas which are formed by phase-coherent combining of the outputs from multiple stationary antenna elements. The array antenna's spatial beam pointing characteristics are determined by the positions of the individual radiators (elements) and the amplitudes, phases, and time-delays of their radiation. The amplitudes, phases, and time-delays are, in general, controlled by the excitation of the individual antenna elements within the array. The antenna array characteristics are also controlled, and usually limited, by the properties of the individual elements in the antenna array and the way in which they interact with each other. These properties include the frequency properties of the individual elements as well as the element gain patterns.

In many cases, antenna arrays are subdivided into smaller arrays known as subarrays. Subarrays, when used, are constructed for ease of mechanical construction as well as for providing a way to minimize the amount of feed and phase control or time-delay structure needed to control the radiation of the individual elements.

The versatility of phased array antennas is convincingly evidenced by their broad range of military and commercial applications including communications, radar, and electronic countermeasures. For all of their advantages, however, performance of phased array antennas is limited. Phased arrays are usually limited in the range of angles over which they can effectively steer a beam without significant losses in overall system gain.

There are two primary reasons for this. These can be seen by first considering an array made up of N individual antenna elements. The overall array gain. G(2), for this N-element system in the direction θ when each element is uniformly illuminated, can be written (in dBi) as, $$G(\theta)=10\log(N)+g(\theta)+10\log(1-|\Gamma(\theta)|^2)-\alpha \quad (1)$$

where g(θ) is the embedded gain pattern for an individual antenna element in the direction θ, Γ(θ) is the active reflection coefficient, and α represents losses in the beam forming network that are independent of Γ(θ). Equation (1) presumes the array is being steered in the θ direction. Thus, the expression does not represent the array pattern but, rather, it represents the gain in the scan direction. In particular Γ(θ) is the effective reflection coefficient when the individual array elements are phased so as to produce a beam in the θ direction. Also g(θ) and Γ(θ) are assumed to be the same for all of the N elements. This latter assumption is an approximation. In practice there will be element-to-element differences. Indeed, for applications involving moderate sized arrays the element-to-element variations in g(θ) may have significant impacts on the array performance.

However, for this example we consider (1) to be a reasonably accurate summary of the array characteristics. Suppose $\hat{G}$ is the desired system gain given by a requirement or specification. This specification can be met at angles for which, $$g(\theta)+10\log(1-|\Gamma(\theta)|^2)\geqq\hat{G}-10\log(N)+\alpha \quad (2)$$

If g(θ) gets too small and/or |Γ(θ)| gets too close to 1, then condition (2) cannot be satisfied. Thus, presuming that the losses α are acceptable, drop off in g(θ) and increase in |Γ(θ)| are the two basic factors that limit the coverage of the array. For certain steer angles the mutual coupling among the elements can become substantial. This leads to an increase in |Γ(θ)| and, consequently, the system may not be able to meet specifications for that range of angles.

In other words, the embedded element gain characteristics as a function of angle and frequency are fundamental limits in the range of angles the array can be scanned to and the frequencies at which it will operate.

Introducing reconfigurability at the individual antenna element level leads to the possibility of much higher performance in gain, pattern shaping, and frequency agility of the individual array elements which then leads to enhanced overall array performance. The purpose of reconfiguration to the array is to adapt the gain characteristics of the individual antenna elements so as to get the maximum possible performance from the antenna system.

Reconfiguration can be used to expand the range of operational functions in a number of ways. First, the embedded array elements can be frequency tuned, and bandwidth can be improved by using reconfiguration to broaden the bandwidth of the embedded elements. In addition, for high gain arrays, beam squint is usually the limiting factor on instantaneous bandwidth. Reconfiguration can alleviate this problem by providing control of the element phase centers. Scan coverage can be improved and scan blindness alleviated by controlling the embedded antenna gain patterns of the elements as well as by providing control of the active impedance as the beam is scanned. Applying limited phase control to the elements themselves can alleviate some of the complexity of the feed manifold.

BRIEF SUMMARY OF THE INVENTION

The invention disclosed here provides reconfigurable antenna arrays designed by selectively placing load impedances in the aperture of the individual antenna elements within an antenna array. These loads can be controlled to change the operational characteristics of the individual antenna element. These characteristics include directivity control, tuning, instantaneous bandwidth, and RCS. By controlling the properties of the individual antenna elements within the array, the performance properties of the array can be changed.

Specifically, this invention builds on parent application Ser. No. 10/206,101 that describes the use of loaded parasitic components within the radiating aperture of an antenna element for the purpose of controlling the RF properties of the antenna element. It also describes the use of a feedback control subsystem that is part of the antenna system which adjusts the RF properties of the parasitic components based on some observed metric of the received waveform. This antenna system is referred to as a controlled parasitic antenna (CPA). By using a feedback control subsystem to control the electromagnetic properties of the antenna aperture, this antenna system can provide multifunctionality and/or mitigate problems associated with reception of an interfering signal or signals within a very compact volume.

In the present invention, by controlling reactive loads or switches attached to a parasitic element co-located with the individual radiating elements within an array or sub-array, the frequency properties of the array can be controlled and the scan angles can be increased. This approach holds promise for overcoming many of the limitations of current phased arrays.

One way of increasing the coverage of the array is by the use of reconfigurable elements. Such elements make use of one or more active control devices embedded in the aperture (specifically in parasitic elements in the aperture) of the individual radiating elements within the array. The impedance of the control device or devices would depend on the value of an applied bias voltage V or voltages ($V_1, V_2, \ldots$). A change in bias values would change the impedances and, consequently, the antenna properties of the element would change. This means that the embedded element gain and the active reflection coefficient become functions of V or ($V_1, V_2, \ldots$) as well as $\theta$. That is, these factors in Expression (1) above can be expressed as $g(\theta, V_1, V_2, \ldots)$ and $\Gamma(\theta, V_1, V_2, \ldots)$. This disclosure teaches that it is possible to design reconfigurable elements so that the coverage of the array can be expanded considerably by varying the state of the elements.

It will also be shown that the implementation of two-state (switchable) devices as controls could be very effective for expanding the coverage of a phased array system. The bias voltages would only need to take on two different values (usually 0 volts and some other voltage that exceeds a switching threshold). The number of independent biases needed would depend on the number of two-state devices per element.

The exemplary embodiment also addresses the loss of array gain that occurs in certain scan directions of an array that seeks to scan from end-fire to angles greater than 25-30 degrees from end-fire. Typically, for a given aperture the maximum achievable gain at angles of about 20° from end-fire is 2-3 dB less than what can be achieved at end fire or at larger scan angles (30° or more from end fire). This will be referred to as the gain depression problem. This problem is particularly acute for applications where a large scan angle range starting at end-fire is desired and the mid-range directions from 15-25 degrees are particularly important. The direction $\theta_D$ relative to end-fire at which this gain depression is most severe will be called the depression scan angle. The value of $\theta_D$ depends on the array size and the electrical length between array elements. This gain reduction can be due to reduced values of $g(\theta_D)$ or increased values of $|\Gamma(\theta_D)|$, or both at the scan depression angle. Significant increases in $|\Gamma(\theta)|$ for certain ranges of scan angles is common with phased arrays and is referred to as scan blindness. For such scan angles there is a significant drop in array efficiency. Reconfiguration can be effective in alleviating scan blindness problems. If this is done at the angle $\theta_D$, the gain depression problem tends to persist due to depressed values in the embedded element pattern $g(\theta_D)$ at this angle. This disclosure demonstrates this problem and teaches potential ways of improving the gain depression problem.

DETAILED DESCRIPTION OF EXEMPLARY EMBODIMENTS

Figure 1:
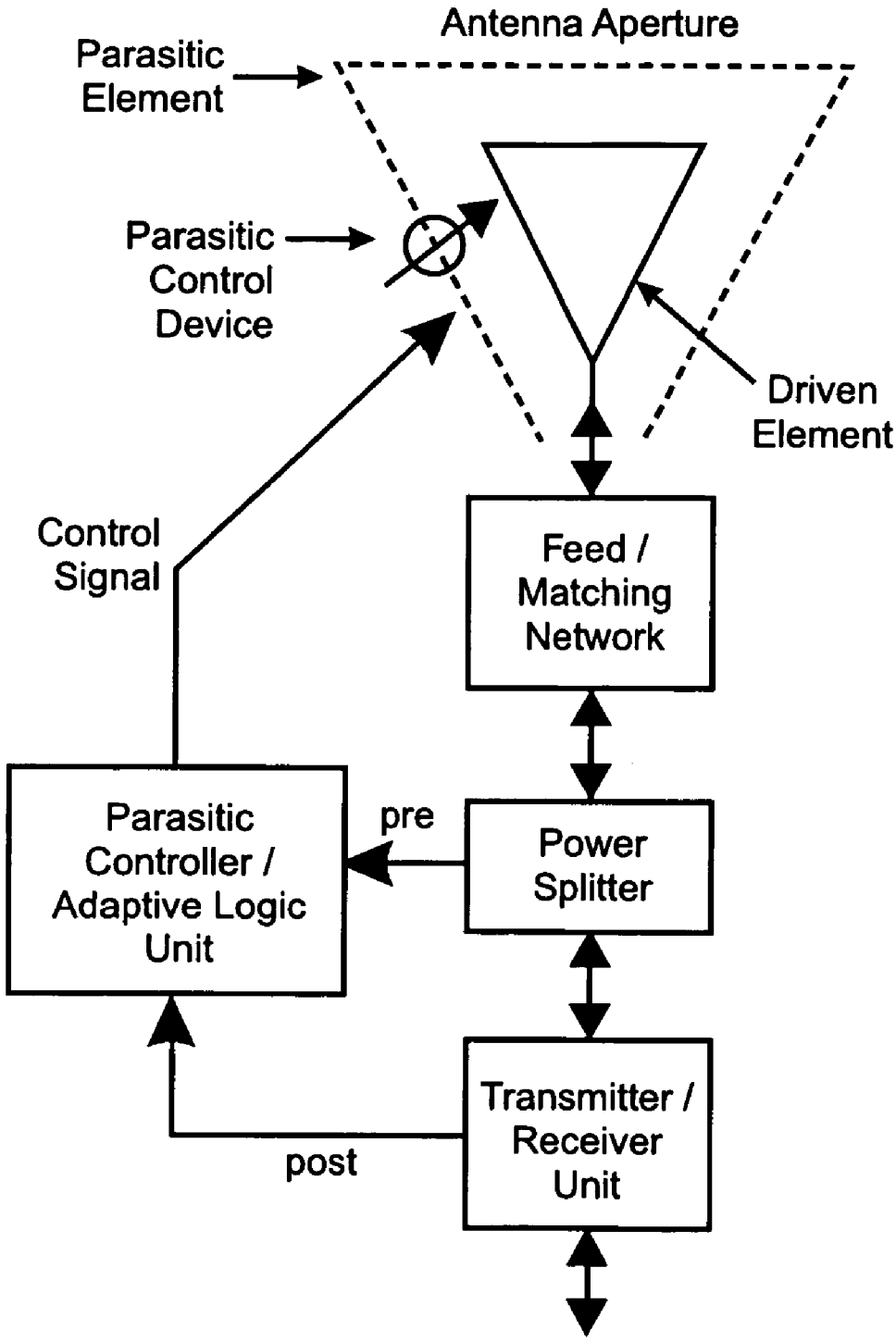
FIG. 1 illustrates a basic block diagram for a single-element controlled parasitic antenna (CPA)

FIG. 1 shows a schematic representation of a single-element controlled parasitic antenna (CPA). The CPA (as taught in parent application 10/206,101) makes use of a feedback loop to adaptively determine the value of the control signal that will control the parasitic control device placed in or near to the parasitic control element in the aperture of the antenna. This feedback loop contains a controller which has an adaptive logic unit, a control signal circuit, and the control device. The control device can be either a two state switch, which usually manifests itself as a two-state reactance, or it can be a continuously variable device (or multiple devices) such as a variable capacitor or varactor used by itself or as part of a control circuit. The feedback loop can tap the output either before (pre) or after (post) the receiver.

There may be situations where both pre and post feedback loops are used. Examples might be where a return loss (VSWR) signal is measured after the matching network and is fed into the adaptive control unit so that the antenna may be retuned to minimize the VSWR. At the same time a receiver error measurement (such as bit error rate) might be made and sent to the adaptive control unit so that the gain pattern may be controlled to minimize the received error.

Figure 2:
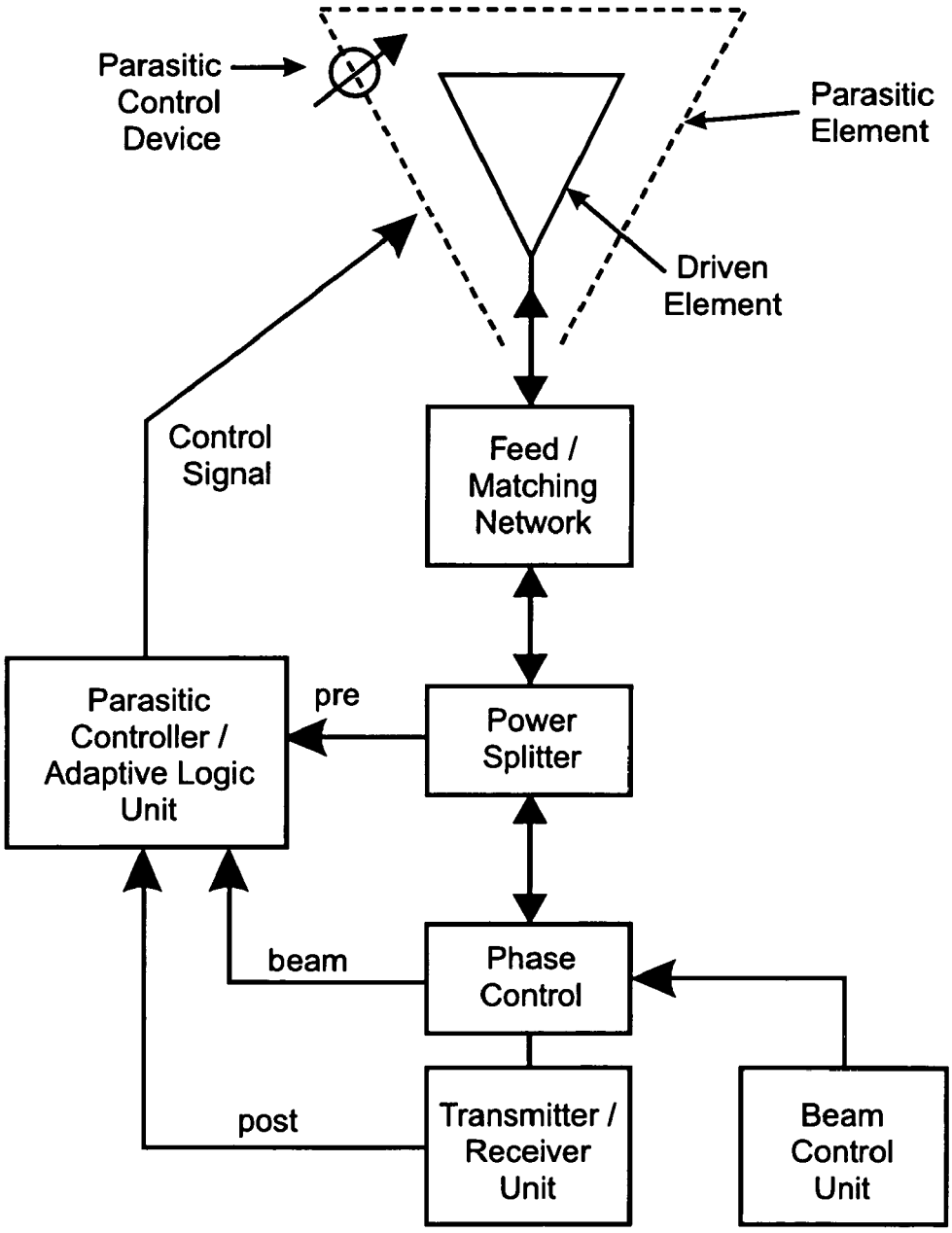
FIG. 2 provides a general block diagram for a single-element controlled parasitic antenna (CPA) element that might be used as an individual element in a phased array.
Figure 3:
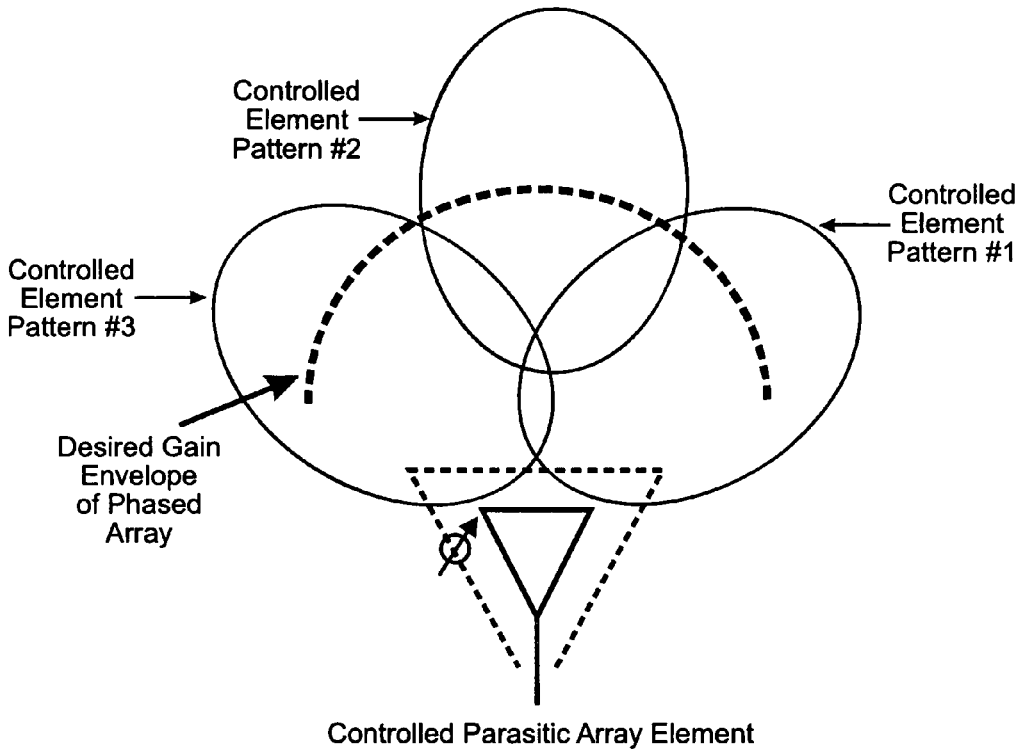
FIG. 3 illustrates a general representation of how the element pattern of an individual element in a phased array is controlled so the phased array can be scanned to that direction.

FIG. 2 shows a schematic representation of the most general configuration of a single-element controlled parasitic antenna (CPA) element that might be used as one of several elements in a phased array. Because this is one of N elements in a phased array, it is necessary to control the phase of the individual element in order to steer the beam of the array. FIG. 2 shows that a phase control unit is controlled by a beam control unit which may be exterior to the individual element. In addition, the beam control unit also can have input into the parasitic control logic unit. In this way, the parasitic control device can be modified to optimize the gain of the antenna element such that as the phased array is scanned, the element pattern will support it. FIG. 3 represents this concept.

The semicircular dotted line in FIG. 3 represents the envelope of the hemispherical scan pattern that we would ideally want to scan a phased array over. Normally, the element pattern within a phased array will not support such a scan envelope. However, if the element pattern can itself be scanned as represented by the controlled element patterns (#1, #2, #3) then the array can then be scanned in the desired directions. In the invention disclosed here, the beam control unit (represented in FIG. 2) would control the phasing of the individual element as well as send a signal to the parasitic control unit which would then set the parasitic control device to the appropriate setting to control the pattern of the driven element.

Figure 4:
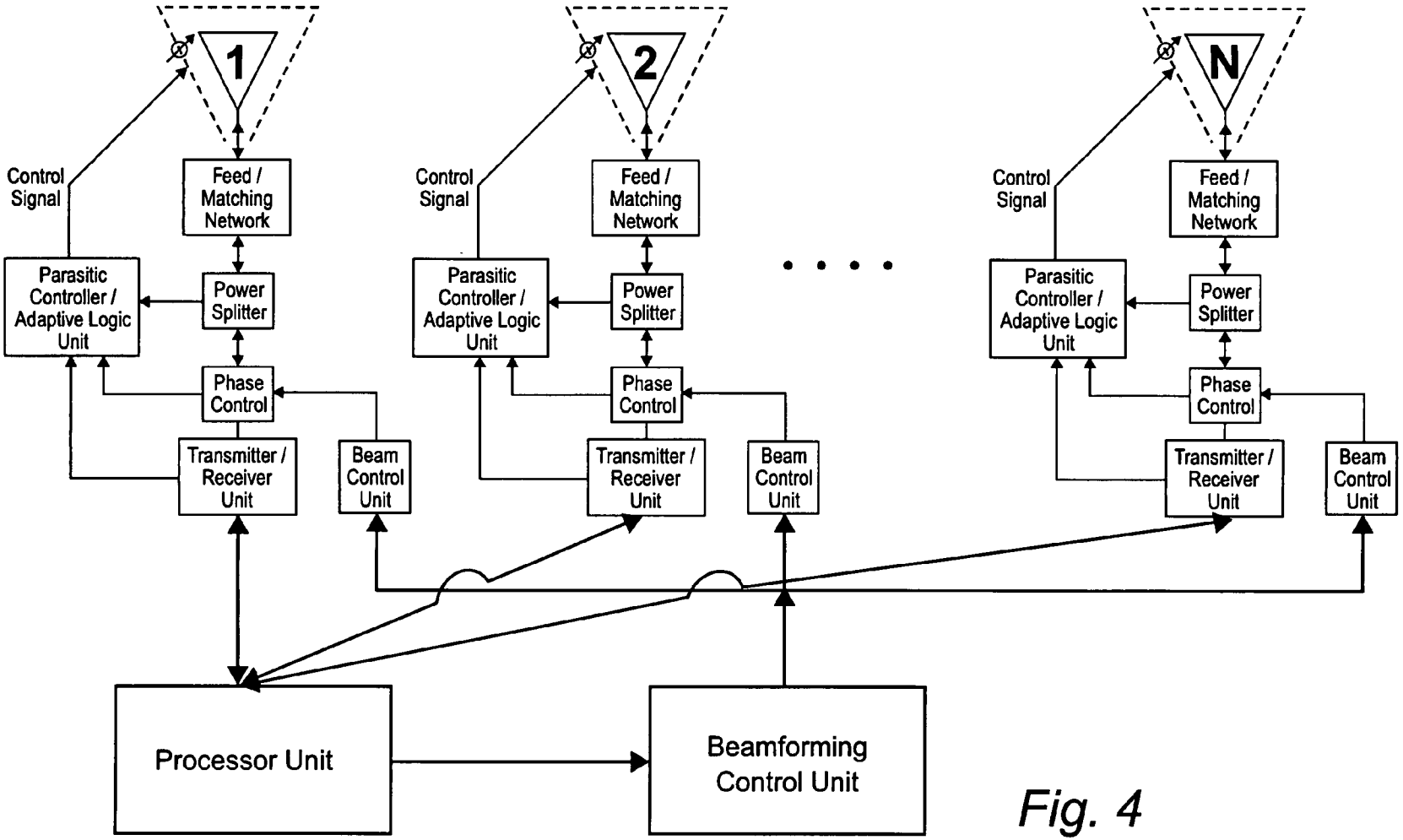
FIG. 4 provides a simplified phased array concept made up of N parasitically controlled elements.
Figure 5:
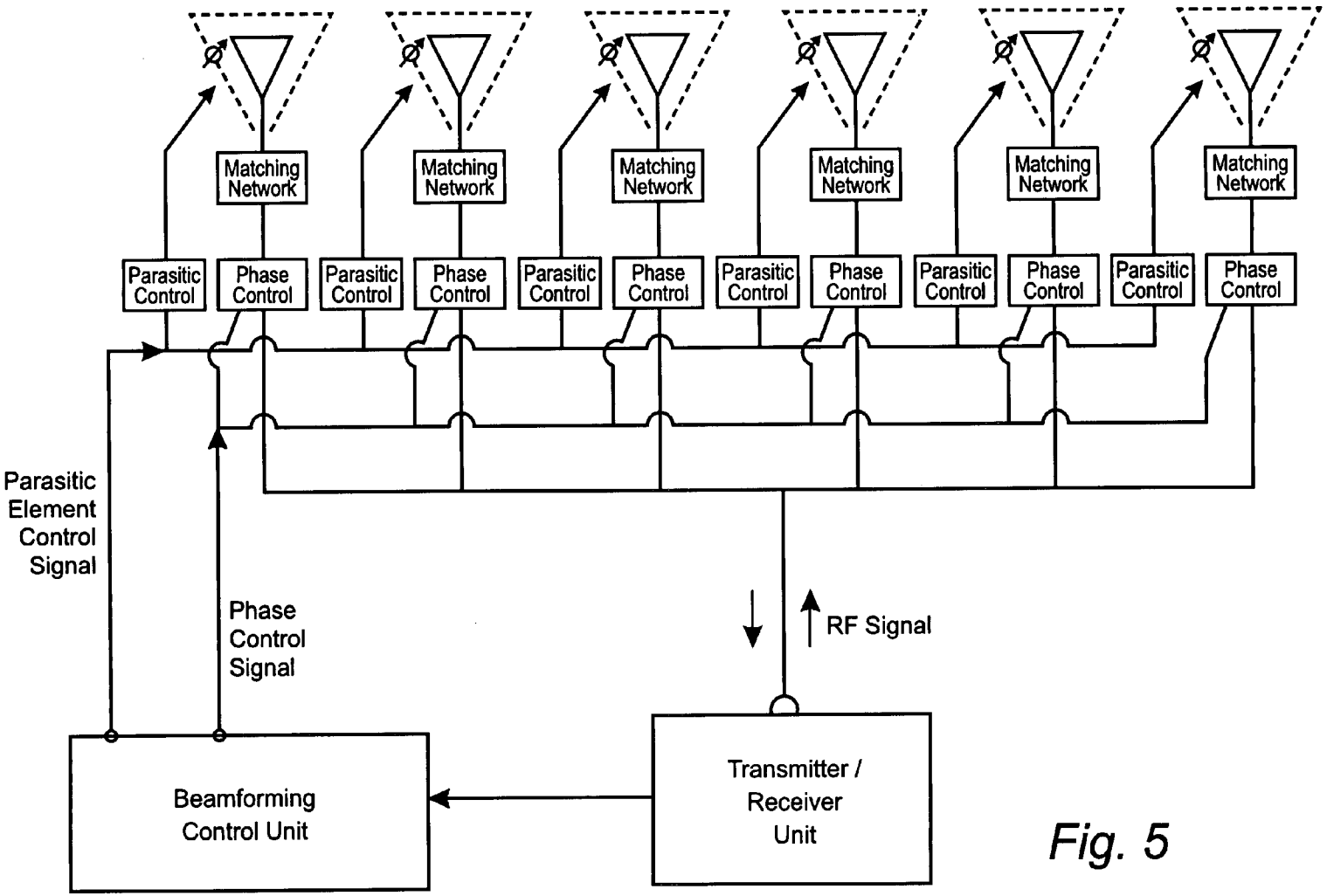
FIG. 5 illustrates a simplified phased array concept made up of parasitically controlled elements all controlled from a single beamforming control unit and corporate fed into a transmit/receive module (which can also represent a single subarray for a larger array)

FIG. 4 shows a phased array configuration made up of N single-element controlled parasitic antennas. In this configuration, there would be a central beamforming control unit to control the steering of the array by controlling the phase of each element as well as controlling the gain pattern of each of the N individual antenna elements via the parasitic controller. The individual elements can have the local feedback control as shown in FIG. 3. The Beamforming Control Unit controls not only the phase of each individual element but it also can control the loading of the parasitic elements associated with each element in the array. This same control can also be used to adjust the magnitude of each element by way of the parasitic control element.

FIG. 4 shows a phased array configuration made up of N single-element controlled parasitic antennas. In this configuration, there would be a central beamforming control unit to control the steering (i.e., the pointing angle) of the array by controlling the phase of each element as well as controlling the gain pattern of each of the N individual antenna elements via the parasitic controller. The individual elements can have the local feedback control as shown in FIG. 3. The Beamforming Control Unit controls not only the phase of each individual element but it also can control the loading of the parasitic elements associated with each element in the array. This same control can also be used to adjust the magnitude of each element by way of the parasitic control element.

Figure 6:
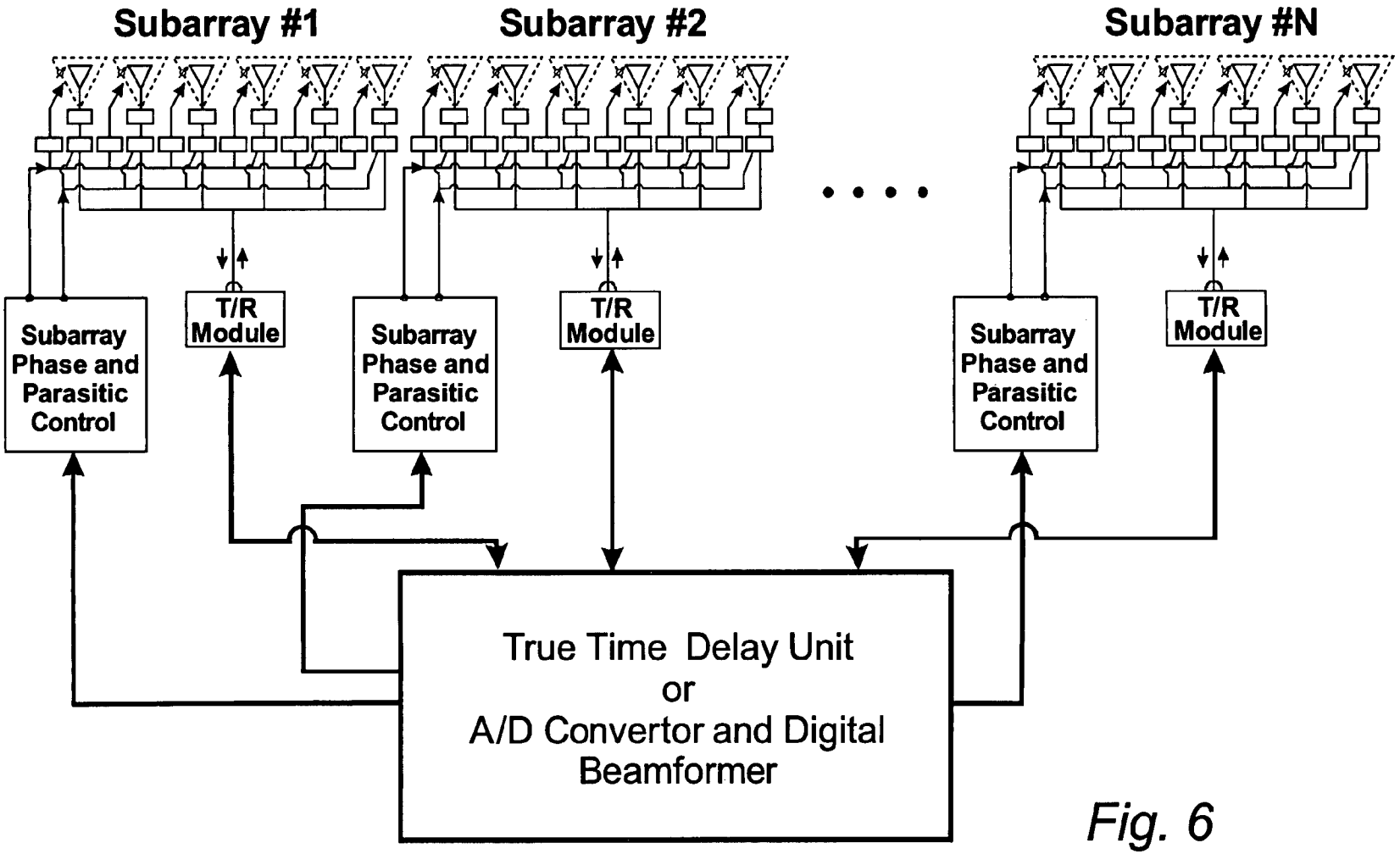
FIG. 6 illustrates a simplified phased array concept made up of parasitically controlled elements in N subarrays.
Figure 7:
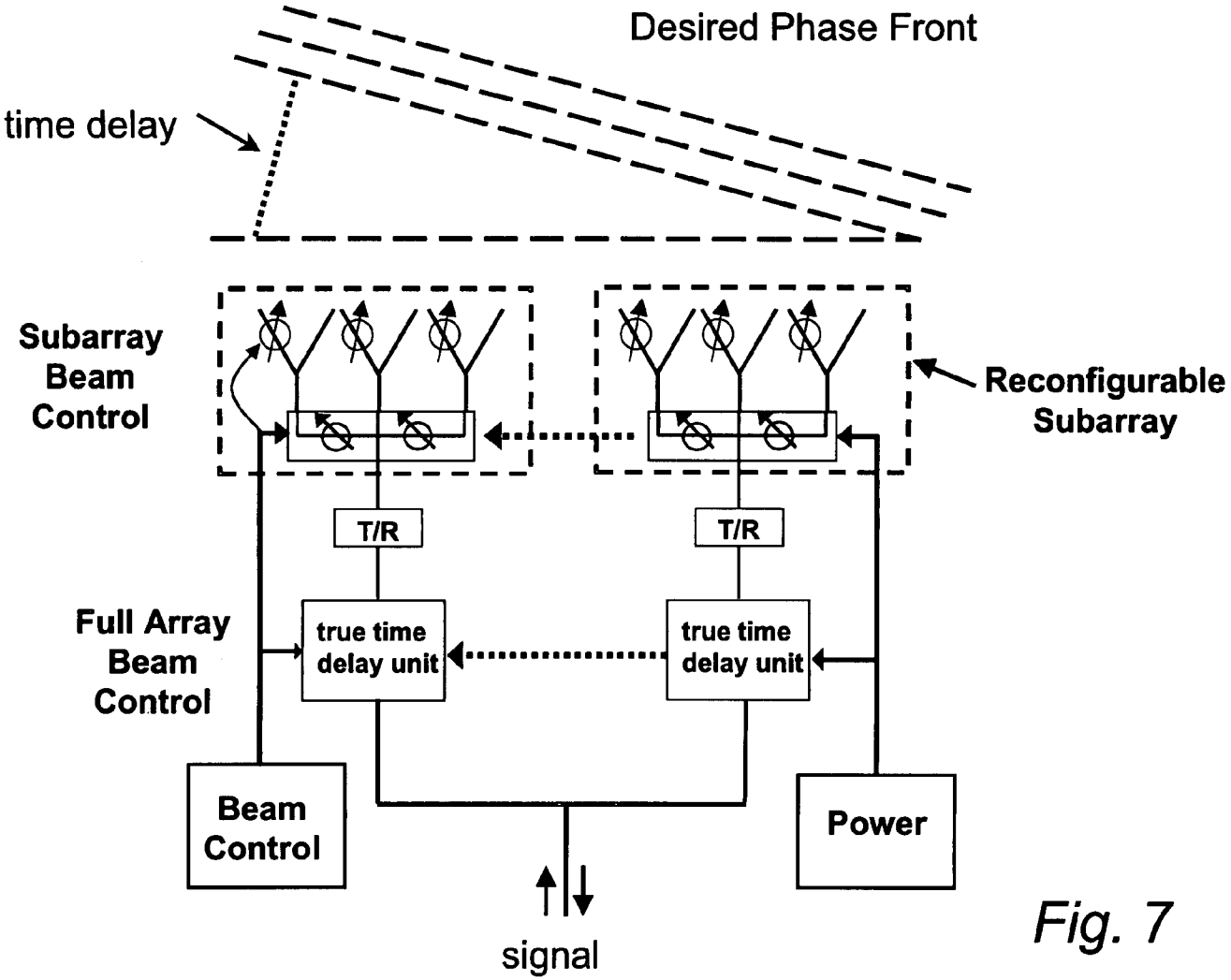
FIG. 7 provides a simple schematic of a generalized phased array made up of reconfigurable subarrays. Each subarray has a T/R module and a true time delay unit attached to it.

In FIG. 6 the beamforming for the array is represented as either being done using true-time delay or done via digital beamforming. In either case, each subarray can still be parasitically controlled to shift the individual element's gain pattern or to retune the antenna element. FIG. 7 presents an alternative depiction of the reconfigurable subarray concept.

Figure 8:
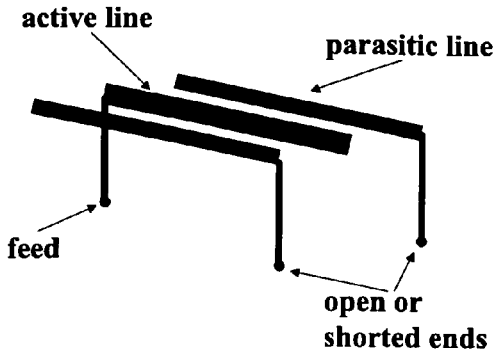
FIG. 8 illustrates a Notional reconfigurable element with loaded parasitic elements.

FIG. 8 shows a notional picture of one type of element that was initially built and tested to quickly demonstrate the concept of this invention. This array of reconfigurable antenna elements can be made as either microstrip elements above a ground plane or simply as bent wires above a ground plane. This element makes use of an active line that is connected by a via (feed point in the picture) to the source. Each driven element also has two parasitic lines that have a connection to the ground plane. For a reconfigurable design these connections would be connected to the ground plane through an electronic switch device. For this test there was no such device. Instead a manual method using silver paint was used to quickly test the concept.

Figure 9:
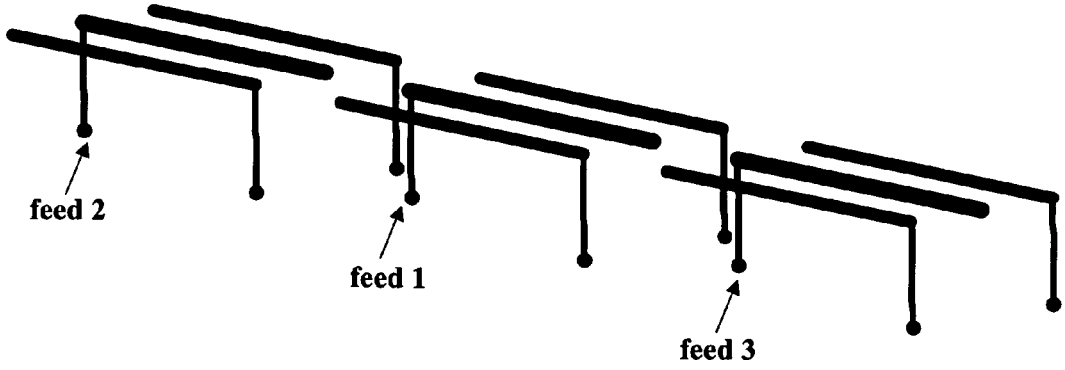
FIG. 9 illustrates a 3 element array of loaded parasitic elements.
Figure 10:
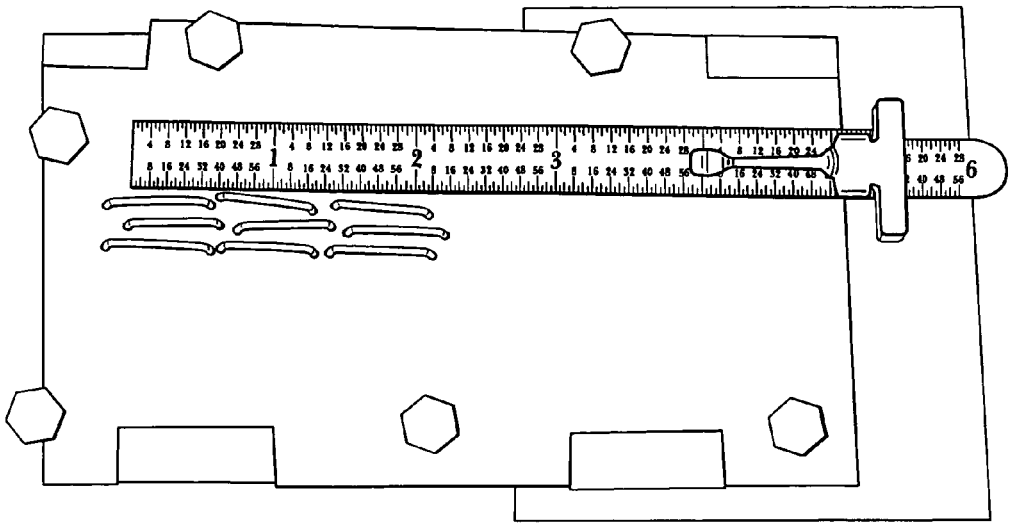
FIG. 10 is a photograph of the three element array of loaded parasitics.

FIG. 9 shows a notional drawing of a 3-element array of these parasitic elements that was fabricated. FIG. 10 is a photograph of the array that was actually built. The ruler indicates the size of the array which is a little more than 2 inches in length. Our primary goal in this initial study was to demonstrate that the embedded element pattern $g(\theta)$ and the active reflection coefficient $\Gamma(\theta)$ can be significantly altered using reconfiguration. This work has focused entirely on two-state control. That is, the elements can be in either of two states. Whether or not a two-state element provides sufficient reconfiguration control depends on eventual application. Some applications are known to require a very large number of element states. Because of the limited nature of this work, the antenna systems built were very small in terms of the number of elements (3 elements). Our primary goal was simply demonstrate that reconfiguration can have a significant effect on the pattern $g(\theta)$ and reflection coefficient $\Gamma(\theta)$. This has been accomplished. Future work will focus on the design of reconfigurable elements and arrays that can achieve optimum performance in accordance with a particular set of design criteria.

Figure 11:
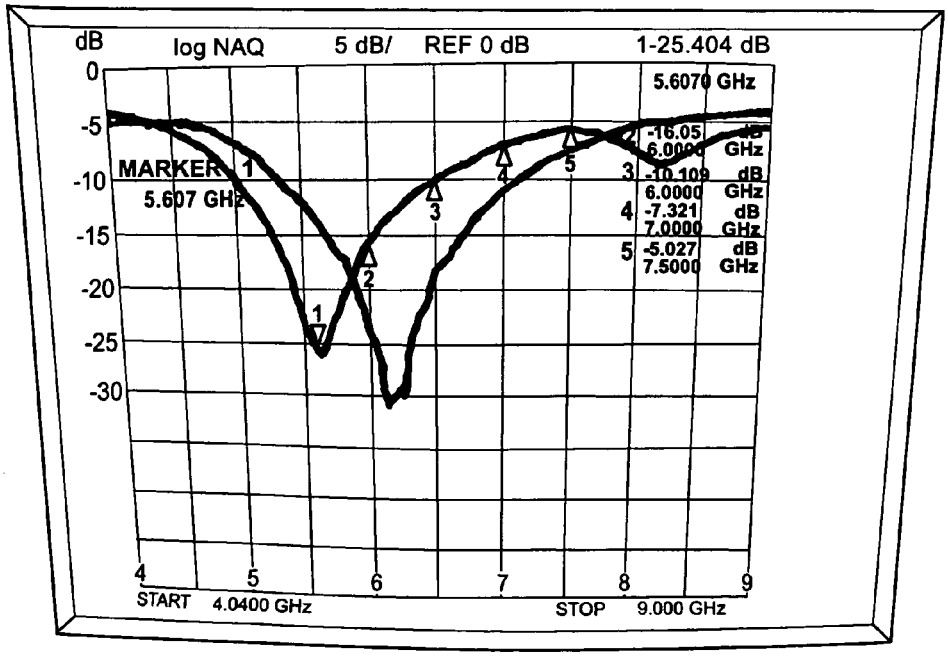
FIG. 11 provides measured reflection coefficient of center element of 3 element parasitic array.
Figure 12:
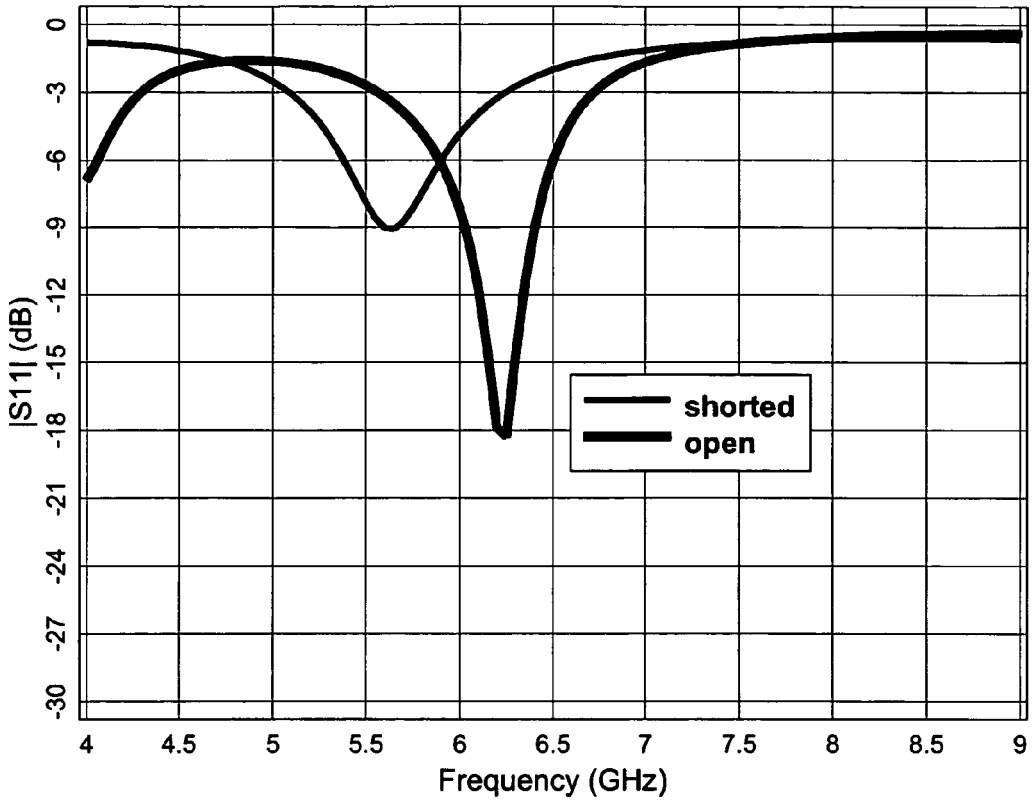
FIG. 12 depicts the computed reflection coefficient of center element of 3 element parasitic array.

The measurements shown in FIG. 11 were performed on the 3-element array of loaded parasitic elements shown in FIG. 10. The figure is actually a picture of the network analyzer screen, which shows the measured reflection coefficient (return loss) at the center element port for both the shorted (arrow-marked curve) and open (unmarked curve) states of the elements. The frequency scale is 4 to 9 GHz in steps of 0.5 GHz. For the shorted state the antenna has its best tuning at 5.6 GHz and the open state is best tuned at 6.2 GHz. The reconfiguration of the element has clearly changed the tuning characteristics. However, there is still a common tuned band for both states, which approximately spans the 5 to 6 GHz range. FIG. 12 shows corresponding computed results for this case. There is a good comparison between the measured and modeled results.

Upon examining FIG. 11 it is seen that the best common frequency (in terms of tuning) of the 2 states is at about 5.9

Figure 13:
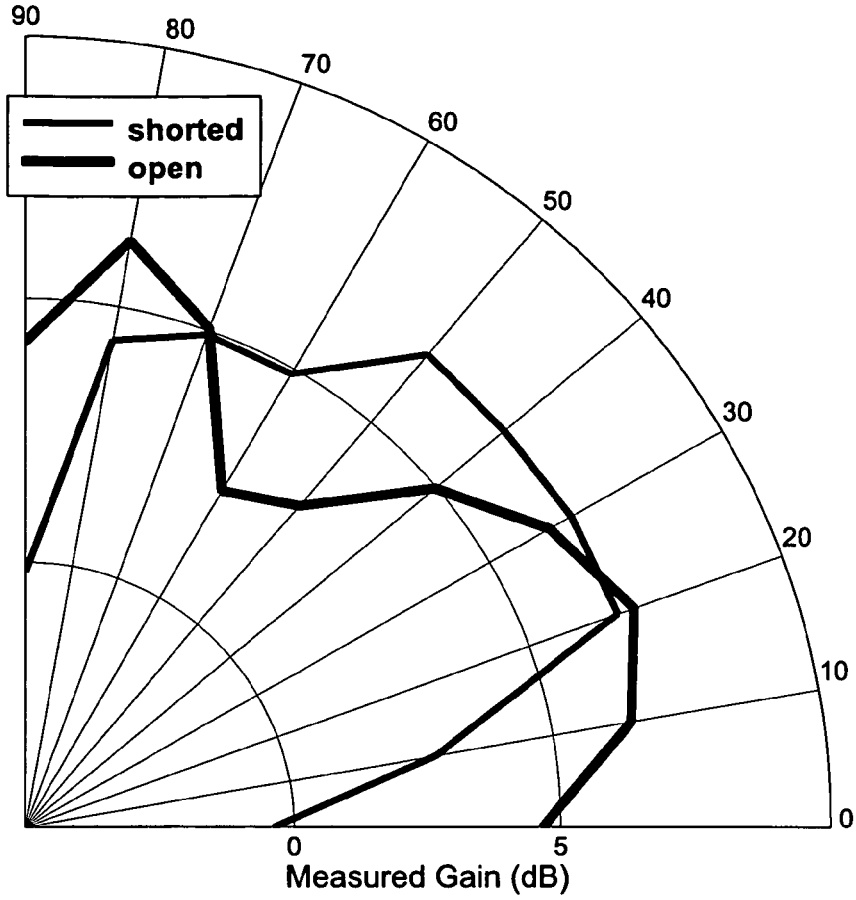
FIG. 13 illustrates the embedded element gain pattern of center element of 3 element parasitic array at 5.9 GHz.

GHz. FIG. 13 shows the patterns that were measured at this frequency for both states. In the figure, 0° would correspond to end-fire and 90° is at broadside to the array. The broadside gain of the shorted state was used as the reference for these measurements. It is clear that reconfiguration has a significant impact on these patterns. Also, it seems clear that from the point of view of $g(\theta)$ that the open state is preferable near end-fire and that the shorted stated is preferable from about 30° to 70° from end-fire.

The initial study was aimed at showing that the use of controllable elements can be effective for expanding the coverage of a phased array system that is constrained to a certain aperture. The technology for accomplishing this is mature and control devices are available with substantial power handling capability. This limited effort has enabled us to demonstrate that reconfiguration can have a very significant impact on $g(\theta)$ and $|\Gamma(\theta)|$, which were discussed in the previous sections.

We performed a limited study to test the concept of switching the state of an element to alter its properties. The eventual goal would be to optimally design such elements in a manner that is favorable to the design of a phased array with substantially broader coverage than would otherwise be possible without the element reconfiguration. This test was limited in scope and focused primarily on laboratory demonstration and experimentation. Active switch devices and biases were not used, as would be the case in an actual application. Instead we built elements and arrays that could be manually switched between two different configurations. This manual switching was accomplished by using silver paint to short an otherwise open end of the element to the ground plane. The paint could be easily removed to restore the 'open state' of the antenna element or array of elements. These two configurations simulated two different element states that could be achieved by using an electronic switch. The properties of the elements were measured and/or computed for both states. In most cases we were able to make good comparisons between measurements and predictions. The results are encouraging and show that both the embedded patterns and active return loss can be significantly controlled using reconfigurable parasitic elements within the phased array.

Figure 14:
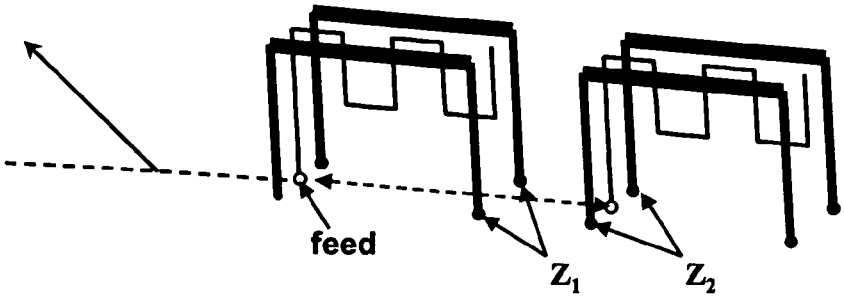
FIG. 14 illustrates a reconfigurable element with loaded parasitic loop.
Figure 15:
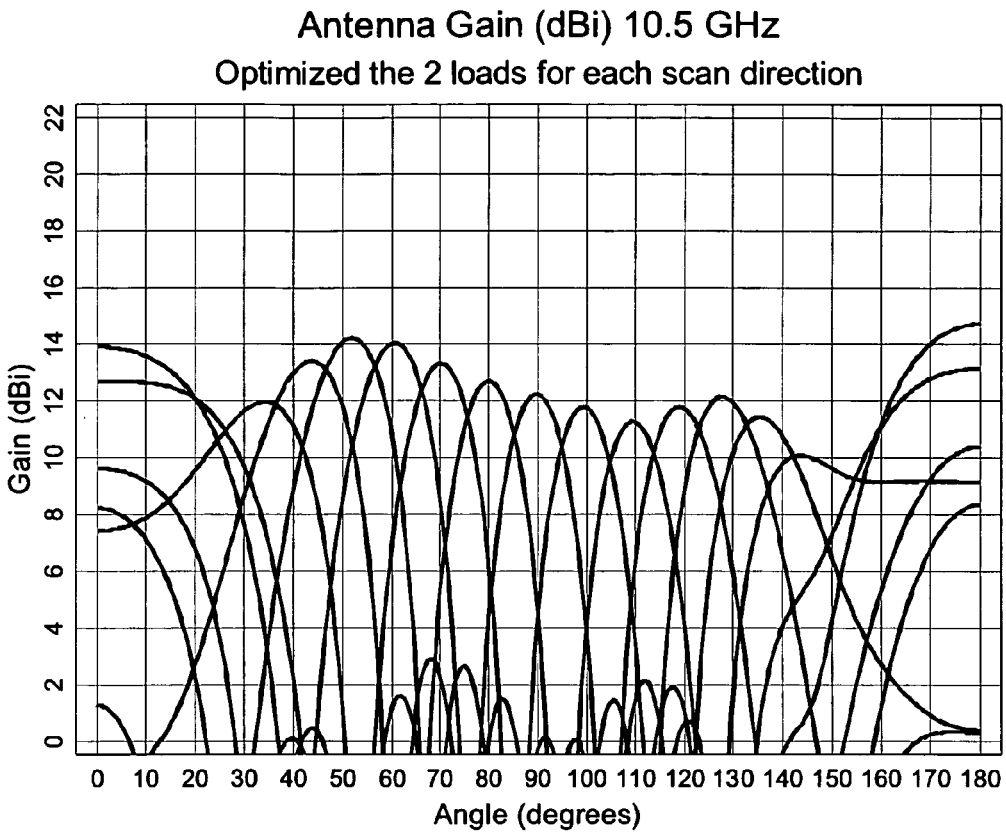
FIG. 15 illustrates beam scans for an 8 element array of loaded parasitic elements.

A reconfigurable array element that offers significant improvement with respect to the reconfigurable lines of the previous section is depicted with loaded parasitics in FIG. 14.

The element shown above has two parts. One is an active 'arm'that connects to the feed port, which is basically a via through the ground plane. On either side of the active arm is a parasitic loop. Each end of one of these loops terminates at a port, which is also a via through the ground plane. Impedances can be applied at these latter ports. These load impedances affect the antenna characteristics of the element. Even though there are 4 load ports there were only two independent load values for the examples that are shown in this section. These are indicated in the above figure. For the studies to be shown these impedances were chosen to maximize the V-pol gain for various scan angles at 10.5 GHz.

Figure 21:
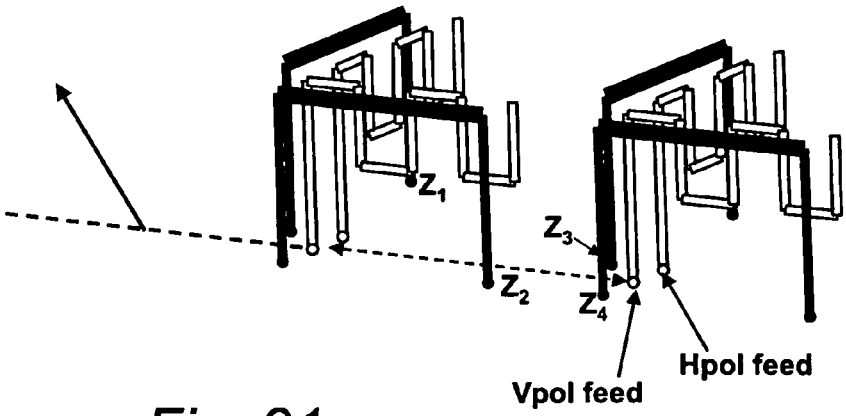
FIG. 21 illustrates a dual polarized element with loaded parasitic loops.

A reconfigurable array element that is a variation of the element shown in FIG. 14 is shown in FIG. 21. This element consists of two active arms of the FIG. 14 element. These active arms are orthogonal. Parasitic elements of the same size as the ones in FIG. 14 are also shown. For this element these parasitic elements are orthogonal. Each element has two feed ports and four load ports. For the study shown in this section the feed ports were combined using a pair of switches and a phase shifter. This enables control over the polarization of the element. For the element shown above the active 'arms' (green) connect to the feed ports. On either side of each active arm is a parasitic loop. Each end of one of these loops terminates at a port, which is a via through the ground plane. Impedances can be applied at these latter ports. These load impedances affect the antenna characteristics of the element. In this case all four load ports were allowed to have independent load values. These are indicated in the above figure. For the studies to be shown these impedances were chosen to maximize the total gain for various scan angles at 10.5 GHz. Note that this element allows for both V-pol and H-pol as well as combinations of these two basic polarizations.

An array based on the reconfigurable element of FIG. 14 can provide good end-fire gain as well as good gain at higher scan angles. However, gain depression problem persists. The next section examines a variation of this element that enables some polarization control. This shows some promise of being able to significantly improve the problem of gain depression.

A reconfigurable array element that is a variation of the element shown in FIG. 14 is shown in FIG. 21. This element consists of two active arms of the FIG. 14 element. These active arms are orthogonal. Parasitic elements of the same size as the ones in FIG. 14 are also shown. For this element these parasitics are orthogonal. Each element has two feed ports and four load ports. For the study shown in this section the feed ports were combined using a pair of switches and a phase shifter. This enables control over the polarization of the element. For the element shown above the active 'arms' (green) connect to the feed ports. On either side of each active arm is a parasitic loop. Each end of one of these loops terminates at a port, which is a via through the ground plane. Impedances can be applied at these latter ports. These load impedances affect the antenna characteristics of the element. In this case all four load ports were allowed to have independent load values. These are indicated in the above figure. For the studies to be shown these impedances were chosen to maximize the total gain for various scan angles at 10.5 GHz. Note that this element allows for both V-pol and H-pol as well as combinations of these two basic polarizations.

Figure 22:
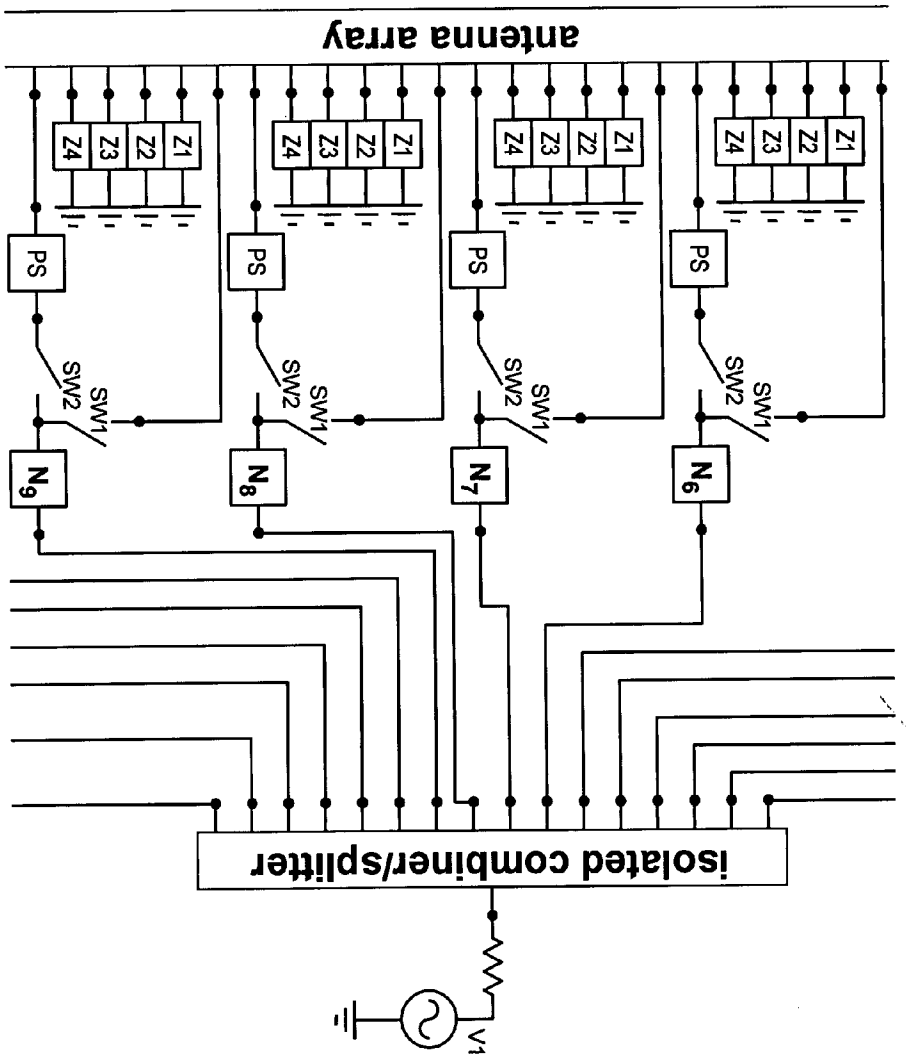
FIG. 22 depicts a section of the network diagram of the dual polarized array showing four of the fed and controlled elements.

A 16-element array was modeled and FIG. 22 shows a portion of the feed and load networks. Note that for each element there is a pair of ideal switches SW1 and SW2 and a relative phase PS between the V-pol and H-pol feeds. Also for each element there are 4 load impedances Z1, Z2, Z3, and Z4. Each switch was allowed to be either on or off. The nth steering phase is indicated as $\phi n$. The set of variables SW1, SW2, PS, Z1, Z2, Z3, and Z4 were constrained to be the same for each element. For each scan angles these values were chosen to maximize the system gain.

Figure 16:
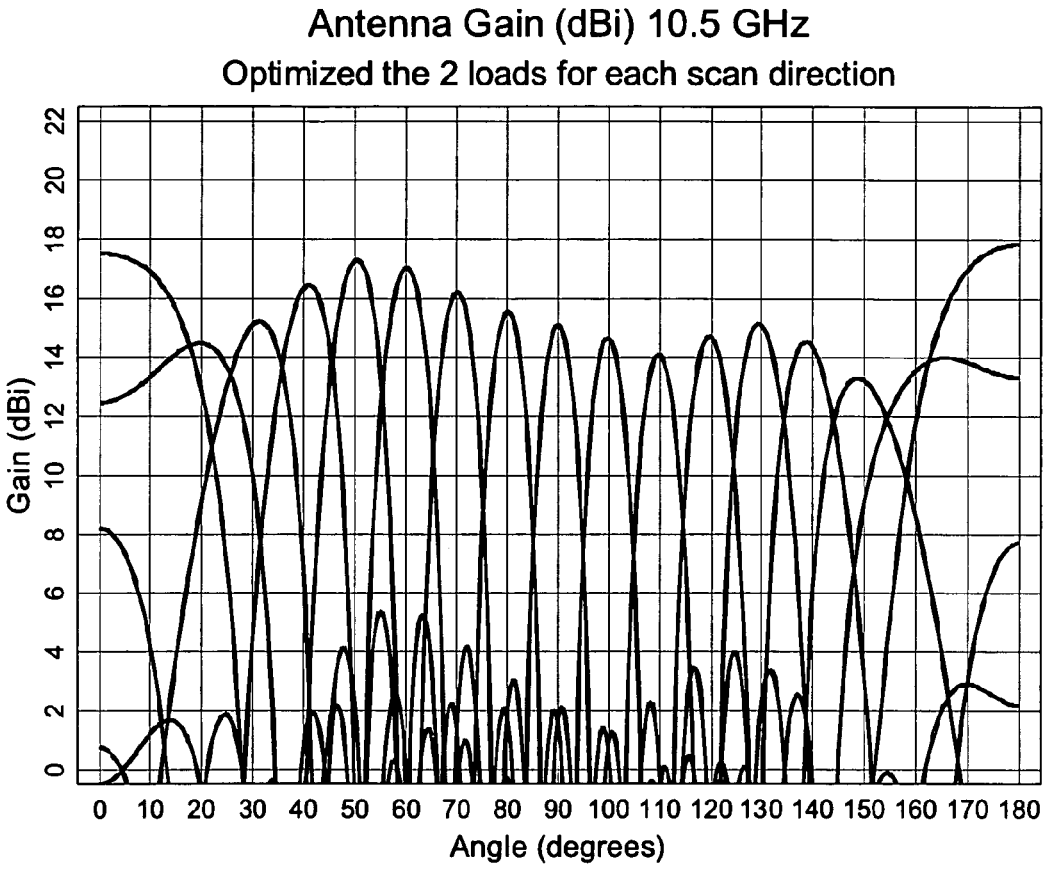
FIG. 16 illustrates beam scans for a 16 element array of loaded parasitic elements.
Figure 17:
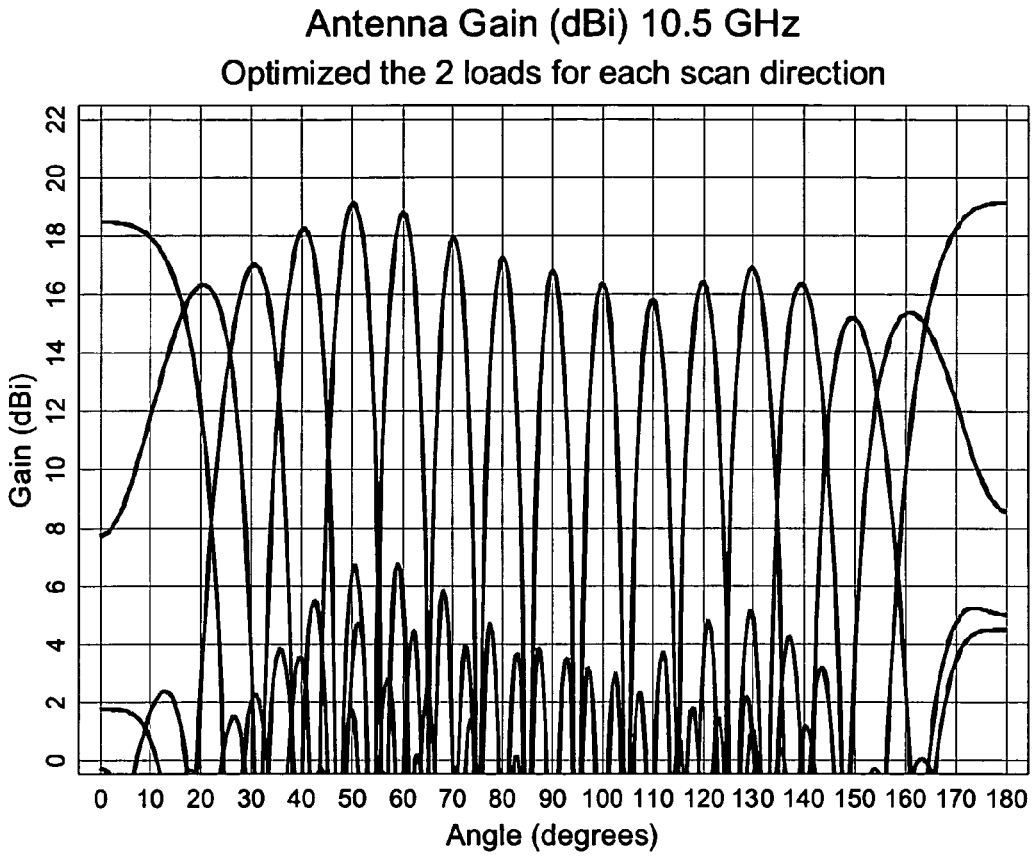
FIG. 17 illustrates beam scans for a 24 element array of loaded parasitic elements.
Figure 18:
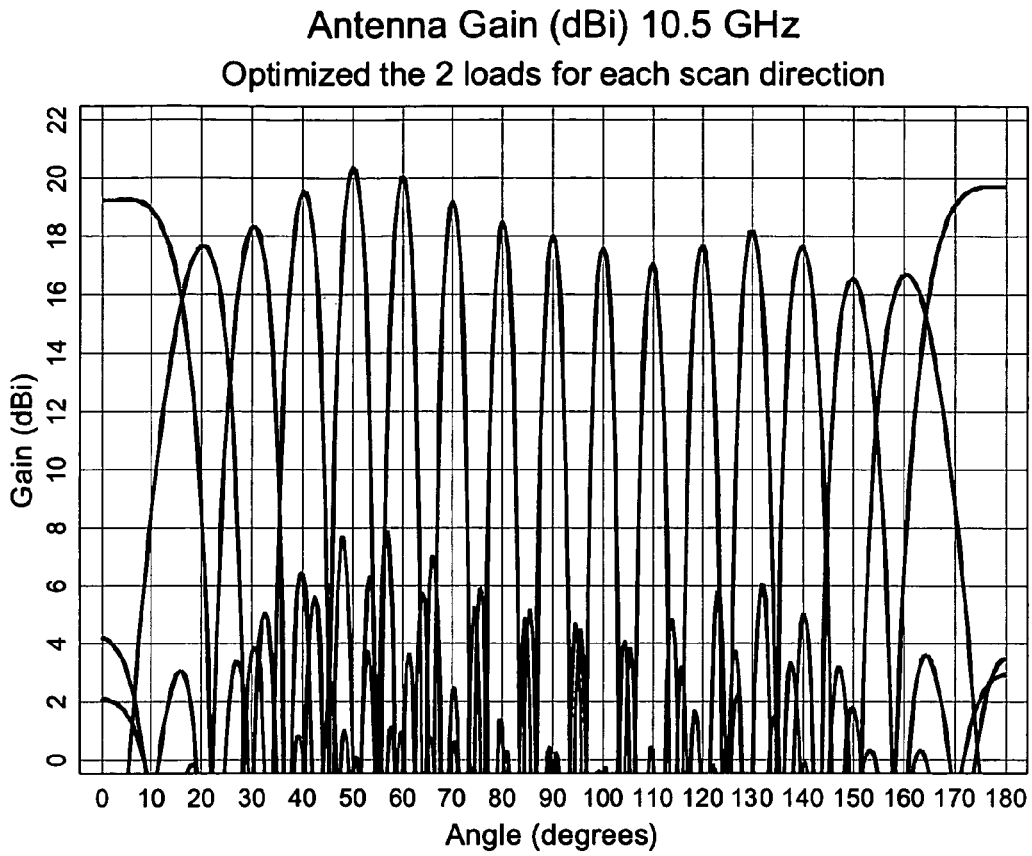
FIG. 18 illustrates beam scans for a 32 element array of loaded parasitic elements.
Figure 19:
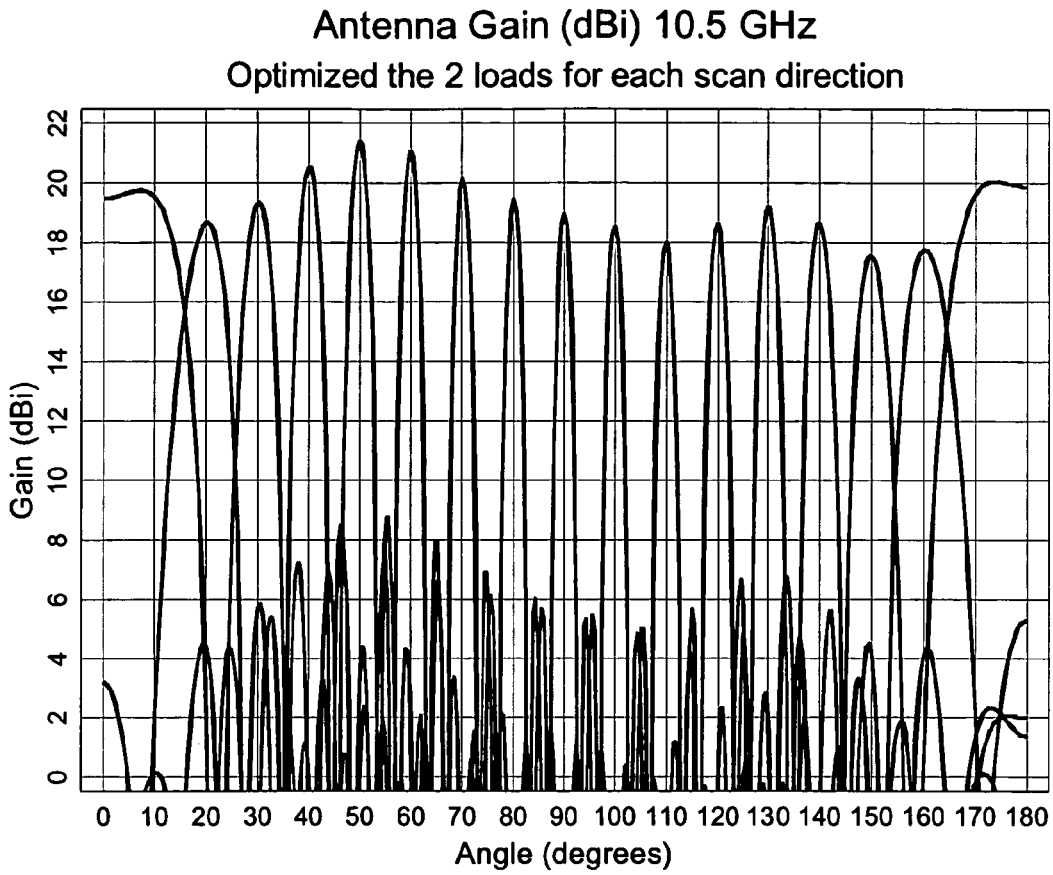
FIG. 19 illustrates beam scans for a 40 element array of loaded parasitic elements.
Figure 20:
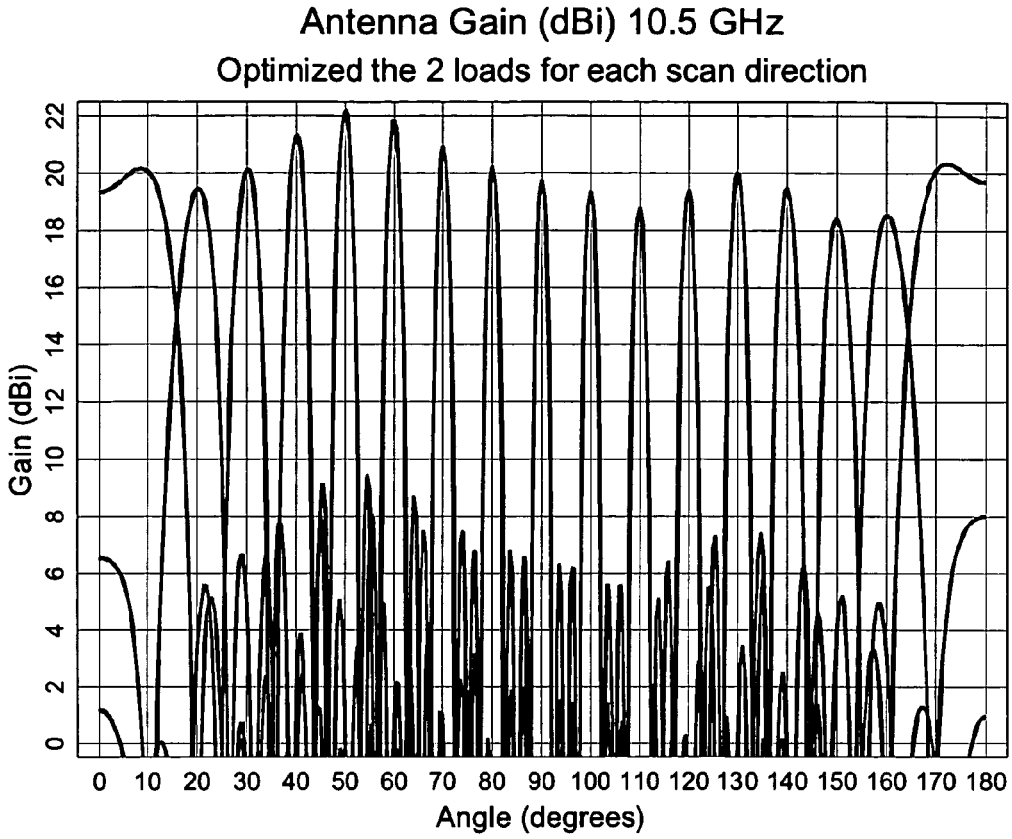
FIG. 20 illustrates beam scans for a 48 element array of loaded parasitic elements.
Figure 23:
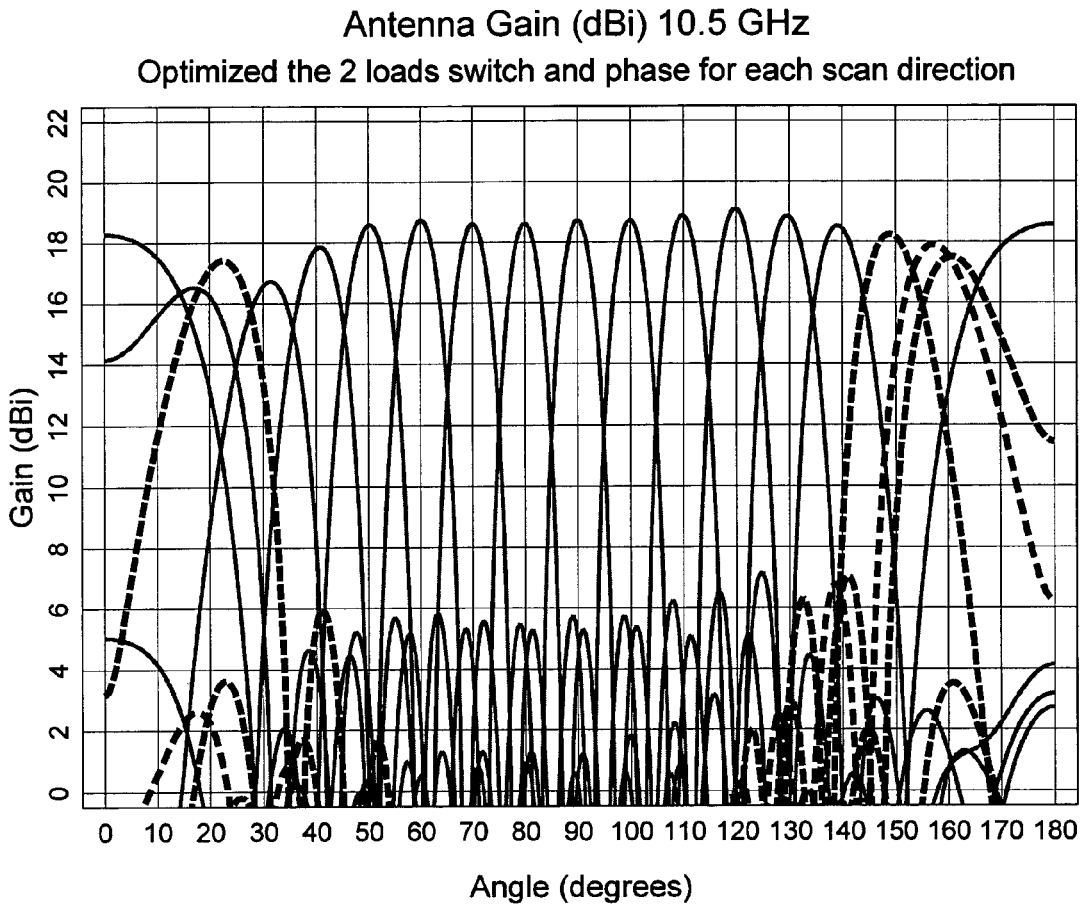
FIG. 23 illustrates beam scans for a 16 element array of dual polarized elements.

FIG. 23 shows the main-beam patterns for the various scan angles that were used. These results should be compared with FIG. 16, which shows the beam patterns of the 16 element array from the previous section. The dual polarized element shows enhanced gain at all scan angles when compared to the previous results. The polarization of the element varies from scan to scan. Gain depression is still noted near the end-fire direction but the magnitude of this depression is not as great as before. It also appears that the gain is somewhat better for the opposite end-fire direction when compared with FIG. 16. This indicates that the dual polarized element should be oriented in the opposite direction to what is shown in FIG. 21.

It was mentioned above that the switch values were variables in the optimization for each scan direction. In most cases the optimization procedure chose both switches to be on with some relative phase between the V-pol and H-pole feeds. The beams for these scans are solid in FIG. 23. However, in a few cases the optimizer "turned off" the V-pol feed in favor of the H-pol feed. These are shown dashed bold lines in the figure. It is interesting to note that these correspond to the directions where the gain depression tends to occur. The gains for these beams have a dominant H-pol component. This indicates that the gain depression problem is related not only to the scan angle but also the polarization of the elements. It appears that elements with variable polarization may provide a means of mitigating gain depression.

Figure 24:
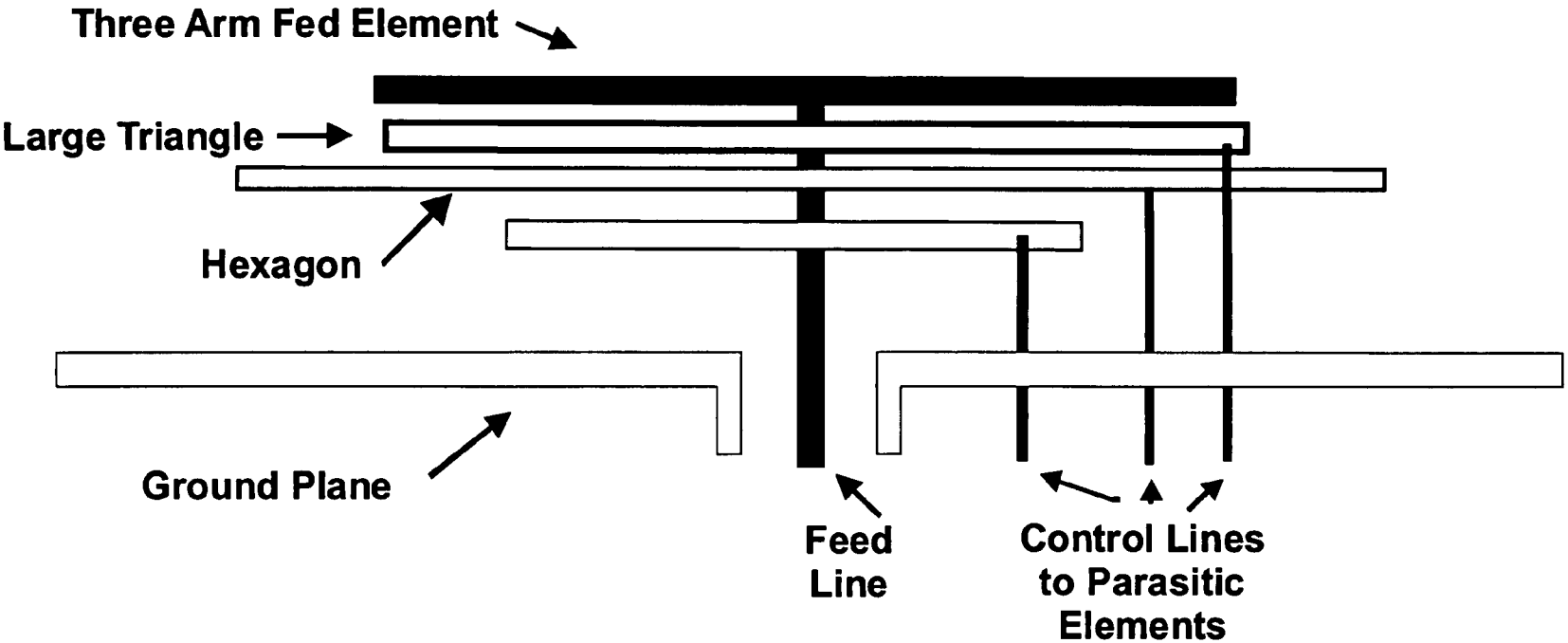
FIG. 24 illustrates an alternate exemplary configuration for parasitic control of an antenna element in an array. In this configuration the controlled parasitic Microstrip elements are placed between the fed (driven) element and the ground plane.
Figure 25:
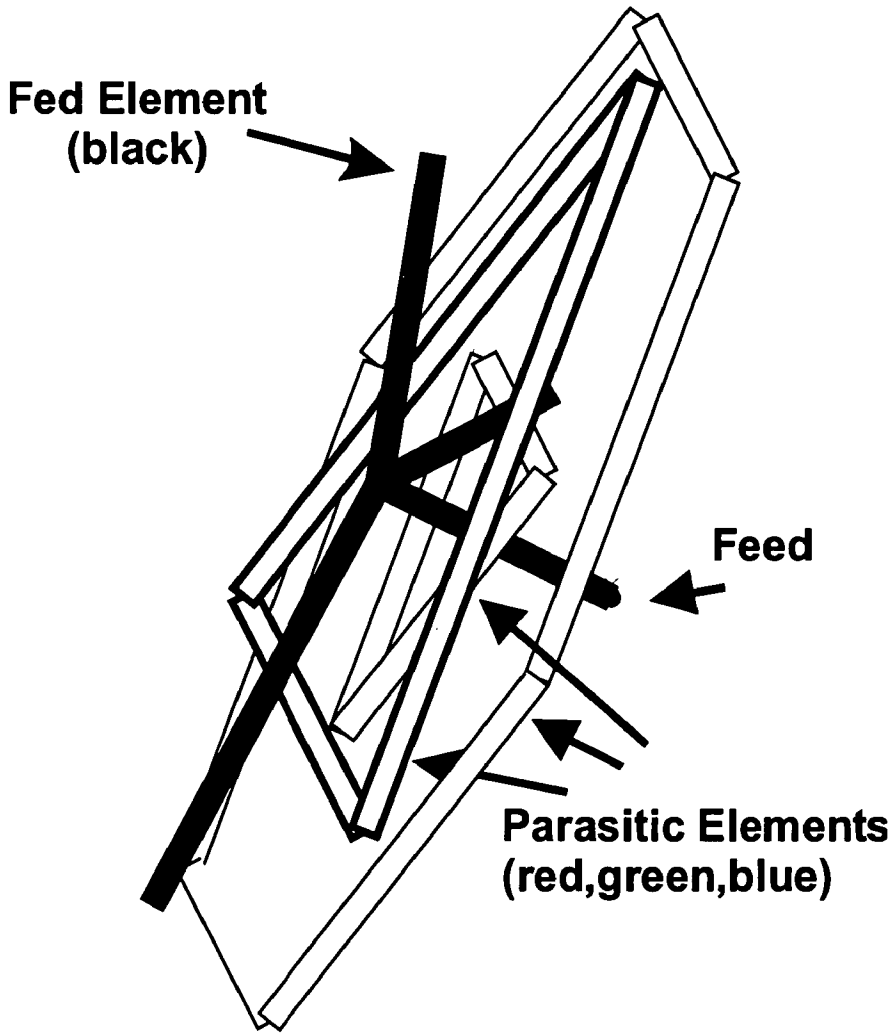
FIG. 25 illustrates another view of the controlled parasitic element of FIG. 24 (wherein the parasitic element control lines are not shown in this view for clarity)
Figure 26:
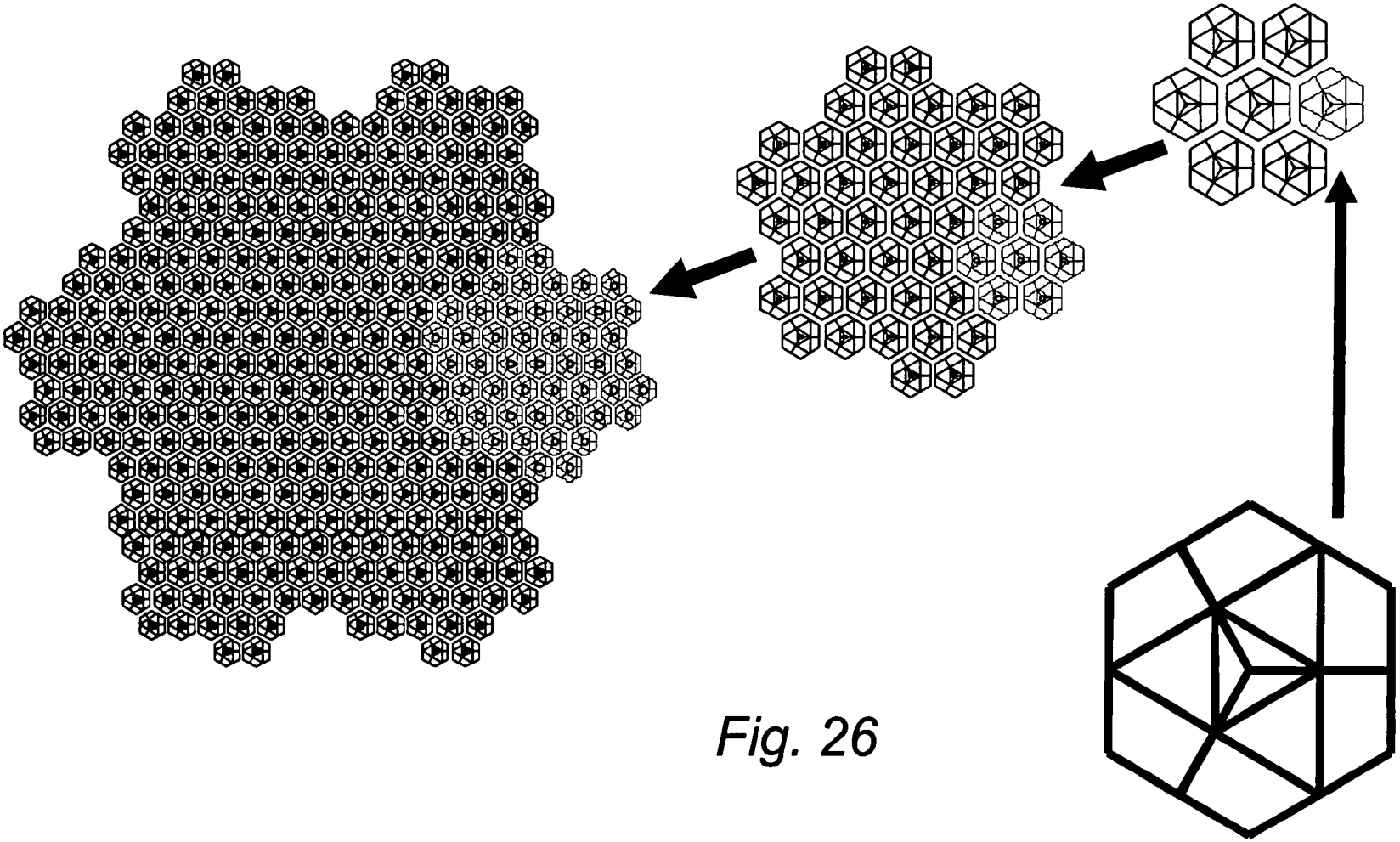
FIG. 26 illustrates how the parasitically controlled element of FIGS. 24 and 25 can be placed in a phased array.

FIGS. 24 and 25 present another possible implementation of a reconfigurable parasitically controlled element that can be used in a phased array. In this case a microstrip radiating (fed or driven) element is placed above the ground plane. This fed element can take many different configurations. In the implementations of FIGS. 24 and 25 a simple three prong radiator is shown. The parasitically controlled elements are placed between the fed element and the ground plane. Again, any number and shape of parasitic elements can be used here. FIG. 26 shows how the single reconfigurable element of FIGS. 24 and 25 can be placed in an array of elements.

Reconfiguration of parasitically controlled elements in a phased array can be used to expand the range of operational functions in a number of ways. First, the embedded array elements can be frequency tuned, and bandwidth can be improved by using reconfiguration to broaden the bandwidth of the embedded elements. In addition, for high gain arrays, beam squint is usually the limiting factor on instantaneous bandwidth. Reconfiguration can alleviate this problem by providing control of the element phase centers. Scan coverage can be improved and scan blindness alleviated by controlling the embedded antenna patterns of the elements as well as by providing control of the active impedance as the beam is scanned. Applying limited phase control to the elements themselves can alleviate some of the complexity of the feed manifold.

A presently preferred method of designing the reconfigurable antennas of this invention is to selectively place controlled parasitic elements in the aperture of each of the antenna elements in the phased array. The parasitic elements can be controlled to change the operational characteristics of the antenna element. The parasitic elements are controlled by either switching load values in and out that are connected to the parasitic elements or are controlled by applying control voltages to variable reactance circuits containing devices such as varactors. The parasitic elements can be controlled by the use of a feedback control subsystem that is part of the antenna system which adjusts the RF properties of the parasitic components based on some observed metric. The controllable characteristics include directivity control, tuning, instantaneous bandwidth, and RCS.

These as well as other objects and advantages of this invention will be apparent to those skilled in the art upon careful study of this entire application. The appended claims are intended to cover not only the described exemplary embodiments of this invention but also all modifications and variations thereof apparent to those skilled in the art in light of the teachings of this patent application.

What is claimed is:

1. A reconfigurable RF antenna array comprising:

a plurality of antenna elements spatially distributed over an array aperture;

wherein at least two of said antenna elements each comprise at least one driven component, and at least one of said antenna elements is a controlled parasitic antenna element that has a largest dimension of about one-half wavelength at the lowest frequency of its operational bandwidth and contains within its radiating aperture (a) at least one driven component, (b) at least one parasitic component, and (c) at least one controllably variable reactance load connected to said at least one parasitic component; and an array controller connected to said at least one variable reactance load to control the electromagnetic properties of said at least one controlled parasitic antenna element and thereby to control, at least in part, a predetermined characteristic of said array.

2. An array as in claim 1 wherein said array controller is also connected to each said driven component to apply weighting to RF signals being fed to/from said driven components thereby to control, at least in part, a predetermined characteristic of said array.

3. An array as in claim 1 wherein:

said array controller is configured and connected to independently control different antenna parasitic components.

4. An array as in claim 1 wherein:

said array controller is configured and connected to control the RF/electrical properties of the parasitic components as well as the phase of associated antenna driven components thereby achieving control over at least an array beam pointing angle.

5. An array as in claim 1 wherein:

said array controller includes a digital beamformer circuit from which information is extracted to at least assist in control of said parasitic components.

6. An array as in claim 5 wherein:

said digital beamformer circuit also provides phase control for said antenna driven components.

7. An RF antenna array as in claim 1 wherein sub-sets of said antenna elements are connected for common control and thus form respective sub-arrays.

8. The reconfigurable RF antenna array as in claim 1 wherein a phase center of said at least one controlled parasitic antenna element is controlled to vary as a function of controlled changes in the variable reactance load connected to said at least one parasitic component of that controlled parasitic antenna element.

9. A method for controlling at least one predetermined characteristic of a reconfigurable RF antenna array, said method comprising:

arranging a plurality of antenna elements spatially distributed over an array aperture;

wherein at least two of said antenna elements each comprise at least one driven component, and at least one of said antenna elements is a controlled parasitic antenna element that has a largest dimension of about one-half wavelength at the lowest frequency of its operational bandwidth and contains within its radiating aperture (a) at least one driven component, (b) at least one parasitic component, and (c) at least one controllably variable reactance load connected to said at least one parasitic component; and controlling changes in at least said at least one variable reactance loads thereby to control the electromagnetic properties of said at least one controlled parasitic antenna element and thereby control, at least in part, a predetermined characteristic of said array.

10. A method as in claim 9 further comprising:

controlling RF signals being fed to/from said driven components thereby to control, at least in part, a predetermined characteristic of said array.

11. A method as in claim 9 wherein:

said controlling step includes independent control of different antenna parasitic components.

12. A method as in claim 9 wherein:

said controlling step includes controlling the RF/electrical properties of parasitic components as well as the phase of associated antenna driven components thereby achieving control over at least an array beam pointing angle.

13. A method as in claim 9 wherein:

said controlling step includes at least some digital beamformer control of said parasitic components.

14. A method as in claim 13 wherein:

said controlling step also includes at least some digital beamformer control of the phase of said antenna driven components.

15. A method as in claim 9 wherein sub-sets of said antenna elements are connected for common control and thus form respective sub-arrays.

16. The method as in claim 9 wherein a phase center of said at least one controlled parasitic antenna element is controlled to vary as a function of controlled changes in the variable reactance load connected to said at least one parasitic component of that controlled parasitic antenna element.

17. A method for providing a reconfigurable RF antenna array, said method comprising:

co-locating at least one reactively-controlled parasitic component with at least one driven component within an antenna element radiating aperture having a largest dimension of about one-half wavelength at the lowest frequency of its operational bandwidth for at least one of plural radiating antenna apertures having a driven component in a phased array of radiating antenna element apertures; and controlling said parasitic components by changing the value of a reactance connected thereto to change operational characteristics of the corresponding co-located driven and parasitic antenna components for said at least one of plural radiating apertures in said array to control, at least in part, a predetermined characteristic of said array.

18. A method as in claim 17 wherein said parasitic components are controlled by either switching reactive load values in and out that are connected to the parasitic components or by applying control voltages to variable reactance circuits.

19. A method as in claim 18 wherein at least some of said variable reactance circuits include a varactor.

20. A method as in claim 17 wherein parasitic components are controlled by use of a feedback control subsystem that adjusts RF properties of the parasitic components based on an observed metric.

21. A method as in claim 17 wherein the parasitic components are controlled to effect changes in at least one of the group of characteristics consisting of directivity, frequency tuning, instantaneous bandwidth, polarization and radar cross section.

22. A method as in claim 17 wherein:

said controlling step includes independent control of different antenna parasitic components.

23. A method as in claim 17 wherein:

said controlling step includes controlling the RF/electrical properties of the at least one parasitic components as well as the phase of associated antenna driven components thereby achieving control over at least an array beam pointing angle.

24. A method as in claim 17 wherein:

said controlling step includes at least some digital beamformer control of said parasitic components.

25. A method as in claim 24 wherein:

said controlling step also includes at least some digital beamformer control of the phase of antenna driven components.

26. The method as in claim 17 wherein a phase center of said at least one controlled parasitic antenna element is controlled to vary as a function of controlled changes in the variable reactance load connected to said at least one parasitic component of that controlled parasitic antenna element.

* * * * *